US007242641B2

(12) United States Patent
Sato et al.

(10) Patent No.: US 7,242,641 B2
(45) Date of Patent: Jul. 10, 2007

(54) TIMEPIECE DIAL AND PRODUCTION METHOD THEREFOR

(75) Inventors: Masaaki Sato, Yamanashi-ken (JP); Hiroshi Takabe, Yamanashi-ken (JP); Toshio Hosotani, Yamanashi-ken (JP); Katsuyuki Yamaguchi, Nishitokyo (JP)

(73) Assignees: Citizen Seimitus Co., Ltd., Yamanashi-ken (JP); Citizen Watch Co., Ltd., Tokyo (JP)

( * ) Notice: Subject to any disclaimer, the term of this patent is extended or adjusted under 35 U.S.C. 154(b) by 83 days.

(21) Appl. No.: 10/399,780

(22) PCT Filed: Oct. 29, 2001

(86) PCT No.: PCT/JP01/09483

§ 371 (c)(1),
(2), (4) Date: Apr. 28, 2003

(87) PCT Pub. No.: WO02/37193

PCT Pub. Date: May 10, 2002

(65) Prior Publication Data

US 2004/0032797 A1 Feb. 19, 2004

(30) Foreign Application Priority Data

Nov. 1, 2000 (JP) ..... 2000-335074
Mar. 14, 2001 (JP) ..... 2001-071584
Mar. 27, 2001 (JP) ..... 2001-091348

(51) Int. Cl.
*G04B 1/00* (2006.01)

(52) U.S. Cl. ..... 368/205; 368/232

(58) Field of Classification Search ..... 368/228, 368/232, 234, 205; 136/246, 251, 259; 427/164; 428/67, 68, 187, 117, 173, 161, 163, 168; 40/315, 331

See application file for complete search history.

(56) References Cited

U.S. PATENT DOCUMENTS 2,376,305 A * 5/1945 Bauer ..... 428/68
3,615,853 A * 10/1971 Paine et al. ..... 136/246
3,806,398 A * 4/1974 Lasser ..... 428/67
5,734,628 A 3/1998 Akasaka et al.
5,782,993 A * 7/1998 Ponewash ..... 136/251
5,807,440 A 9/1998 Kubota et al.
5,912,064 A * 6/1999 Azuma et al. ..... 428/141
6,021,099 A * 2/2000 Aoki et al. ..... 368/205
6,284,708 B1 * 9/2001 Oshima et al. ..... 503/227
6,372,977 B1 * 4/2002 Miyoshi ..... 136/246
6,466,522 B1 * 10/2002 Yoshioka et al. ..... 368/223
6,473,666 B1 * 10/2002 Samura ..... 700/117
6,489,266 B1 * 12/2002 Kurokawa et al. ..... 503/227

FOREIGN PATENT DOCUMENTS

| | | |
|---|---|---|
| EP | 0803784 | 10/1997 |
| EP | 0895141 | 2/1999 |
| EP | 924580 | 6/1999 |
| JP | 60148172 | 5/1985 |

(Continued)

*Primary Examiner*—Ren Yan
(74) *Attorney, Agent, or Firm*—Dennison, Schultz & MacDonald

(57) ABSTRACT

A dial for a watch has a transmissive substrate (11) and a series of projections and recesses (11*a*, 11*b*). A nontransmissive film (12) is formed in each of the recesses with a metallic film.

20 Claims, 27 Drawing Sheets

FOREIGN PATENT DOCUMENTS

| | | | |
|---|---|---|---|
| JP | 07134185 A | * | 5/1995 |
| JP | 07198866 A | * | 8/1995 |
| JP | 08211161 A | * | 8/1996 |
| JP | 09189775 A | * | 7/1997 |
| JP | 09269382 A | * | 10/1997 |
| JP | 10/206560 | | 8/1998 |
| JP | 10/253773 | | 9/1998 |
| JP | 10206560 | | 11/1998 |

* cited by examiner

TIMEPIECE DIAL AND PRODUCTION METHOD THEREFOR

This application is a filing under 35 USC 371 of PCT/JPO01/09483 filed Oct. 29, 2001.

TECHNICAL FIELD

The present invention relates to a dial for a watch, and more particularly to a dial for a solar cell watch or for an electroluminescence and a method for manufacturing the dial.

BACKGROUND ART GRINDED

In order to provide a solar cell watch in which the dial of the solar cell watch is visible as a metal plate and the deep purple of the solar cell is invisible, there is proposed a dial of solar cell shown in FIG. 49. The dial comprises a transmissive substrate 1 made of transparent plastic and a metal film 2 formed on the underside of the substrate and having a plurality of small apertures 2*a* disposed at regular intervals. The diameter of the aperture 2*a* is smaller than 30 μm. If the diameter is smaller than 30 μm, the aperture is invisible, and hence the solar cell disposed under the dial is also invisible.

Generally, the solar cell is equally divided into four divisions A1, A2, A3 and A4 as shown in FIG. 50. The quantity of light passing through the dial is equally irradiated to the four divisions. By disposing the small apertures 2*a* at regular intervals, four divisions are equally irradiated by the transmission light. The total area of small aperture is set to a range between 25 and 50% of the total area of the dial. If the total area of the small aperture 2*a* is set to 25%, transmittance of 25% is secured, which ensures sufficient generated energy. If the total area of the small aperture exceeds 50%, the deep purple of the solar cell is visible.

In a manufacturing process for such a dial for the solar cell, a number of steps and a high manufacturing cost are necessary. Furthermore, since the aperture is very small, it is difficult to make the dial at high accuracy. Consequently, the manufacturing process is low in yield and improper in mass production. Further, etching agent and stripping agent used in the process are ill for the human body.

An object of the present invention is to provide a dial for a watch and a manufacturing method for the dial may be manufactured by a simple process at a low cost at high accuracy without injury to the human body.

DISCLOSURE OF THE INVENTION

A dial for a watch according to the present invention is characterized by comprising a transmissive substrate, a series of projections and recesses formed on a first surface of the substrate, and a nontransmissive film formed in each of the recesses.

The projections and recesses are formed into a predetermined pattern, and a projected surface of the projection is formed into a flat smooth face.

A colored transmissive film is formed on an underside of the nontransmissive film in the recess.

A plurality of projections are formed on a second surface opposite to the first surface, or a color portion by a sublimating dye is formed on the second surface opposite to the first surface.

The nontransmissive film is a metallic film, or a painting film.

The projections and the recesses are disposed at regular intervals.

An ultraviolet rays absorbent may be included in the transmissive substrate.

In an aspect of the present invention, the dial comprises a retainer layer made of a transparent resin on a second surface opposite to the first surface of the substrate, and a picture formed on the retainer layer.

A transparent protection film is formed on the projections and recesses on the second surface of the substrate.

A transparent protector film is formed on the retainer layer.

A method for manufacturing a dial for a watch according to the present invention is characterized by comprising the steps of forming a transmissive substrate having projections and recesses on a first surface by injecting a transparent resin in a mold having projections and recesses, forming a non-transmissive film on the first surface, removing the non-transmissive film on a projected surface of each of the projection to expose the transmissive substrate, and forming the exposed surface of the substrate into a flat smooth surface.

Each of the projections may be formed into a triangular section, a peak portion of the triangular section is removed, and the removed portion may be formed into a flat smooth surface.

A color layer is formed by soaking a sublimating dye in a second surface opposite to the first surface of the transmissive substrate.

The method further comprises the steps of forming a retainer layer on a second surface opposite to the first surface of the transmissive substrate with a transparent resin, forming a picture in the retainer layer by soaking a sublimating dye.

BEST MODE FOR EMBODYING THE INVENTION

A dial for a watch and a method for manufacturing the dial according to the first embodiment of the present invention will be described hereinafter with reference to FIGS. 1-4.

Figure 1:
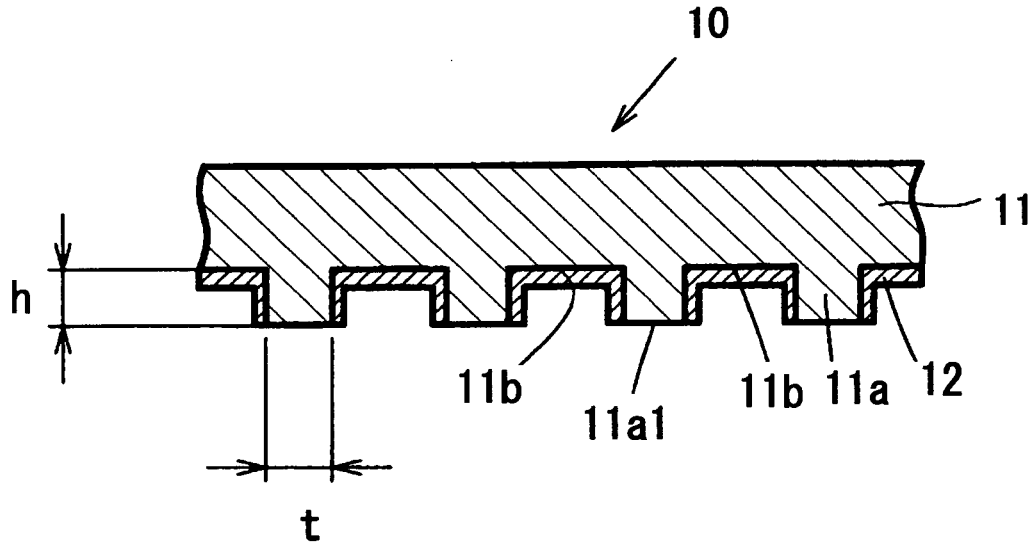
FIG. 1 is an enlarged sectional view of a watch dial according to a first embodiment of the present invention.
Figure 2:
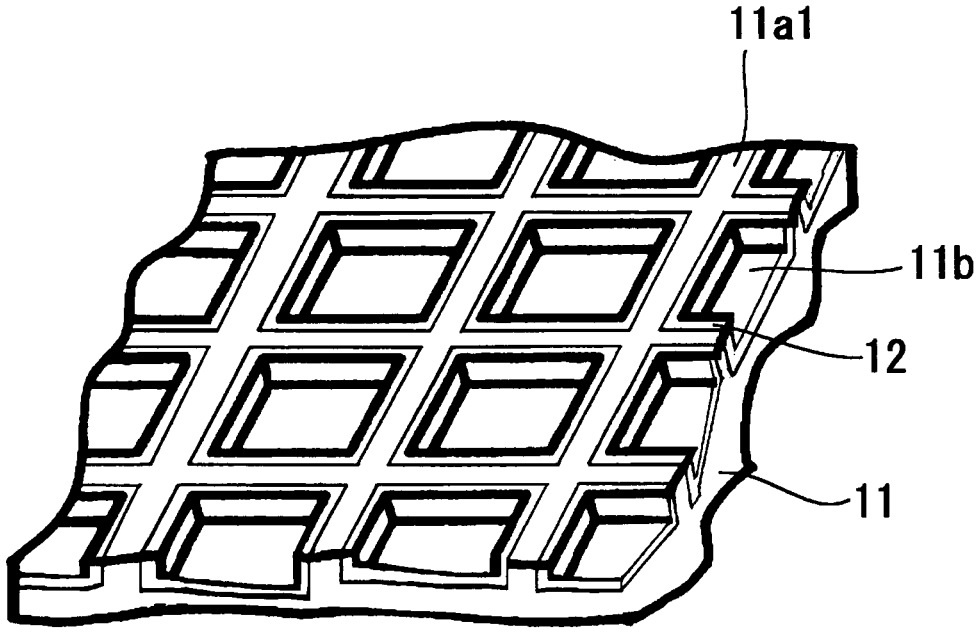
FIG. 2 is an enlarged perspective view of the dial of FIG. 1 as viewed from the underside thereof.

Referring to FIGS. 1 and 2, a dial 10 comprises a transmissive substrate 11 of a transparent plastic and having a series of projection ribs 11*a* and recesses 11*b* formed on the underside thereof, and a nontransmissive film 12 of metal and formed on the inside wall of the recess 11*b*. On the underside surfaces of the projection ribs 11*a*, the nontransmissive film 12 is not formed, thereby transmitting the sunbeam.

More particularly, as shown in FIG. 2, the projection ribs 11*a* are formed into a lattice to form a plurality of projection ribs 11*a*. The underside surface 11*a*1 of each of the projection ribs is grinded to remove the nontransmissive film 12 so as to form a flat surface, thereby to expose the transmissive substrate 11. The recess 11*b* is formed by the surrounding of projection ribs 11*a* and has a square in plan view.

The height h of the projection rib 11*a* is higher than at least 10 μm, the width t of the underside surface 11*a*1 is 70 μm or less. The total area of grinded underside surface 11*a*1 is set in a range between 20 and 50% of the area of the upper surface of the substrate 11.

The nontransmissive film 12 of metal is formed by vacuum deposition of metal into such a thickness that the film does not pass the sunbeams. The nontransmissive film 12 is not limited to the metal film, a paint film formed by printing or painting into such a thickness as not to pass the sunbeam may be used.

The upper surface of the substrate 11 corresponding to the recess 11*b* on which the nontransmissive film 12 is formed has a light reflecting effect due to the nontransmissive film 12. As a result, the surface of the substrate takes on the color of the nontransmissive film 12. On the other hand, the sunbeam passes through the projection ribs 11*a* to irradiate the solar cells (not shown) without diffusing because of the flat surface 11*a*1. Thus, the incident efficiency of the light is increased.

Furthermore, since the width of the underside surface 11*a*1 is very small, the deep purple of the solar cell is hardly visible. In the case that the substrate 11 is slightly colored the deep purple of the solar cell is scarcely visible, if the width t of the underside surface 11*a*1 is 70 μm or less. In particular, when the width t is smaller than 30 μm, the purple can not be seen, even if the substrate is transparent.

Since the total area of the underside surface 11*a*1 of the projection ribs 11*a* is set in a range between 20% and 50% of the area of the upper surface of the dial 10, a sufficient quantity of light for causing the solar cell to generate electric power is obtained. If the total area of surface 11*a*1 exceeds 50%, the effect of the nontransmissive film 12 decreases so that the deep purple of the solar cell becomes visible.

Although the projection ribs 11*a* is formed into a lattice and the recess 11*b* is square, the projections and the recesses may be made into another pattern such as stripe, circle, and geometrical pattern.

A manufacturing method of the above described dial will be described with reference to FIGS. 3*a* through 4.

Figure 3A:
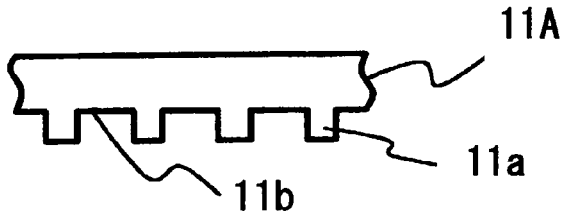
FIGS. 3*a* to 3*c* show a method for manufacturing the watch dial.

FIG. 3*a* shows a blank 11A of the transmissive substrate 11 having projection ribs 11*a* and recesses 11*b* on the underside thereof formed by injection molding. The blank 11A is manufactured by injecting a transparent resin in a mold of an injection molding machine under heating and pressuring of the resin. The projection and recess on the underside are formed by recess and projection provided in the mold.

Figure 3B:
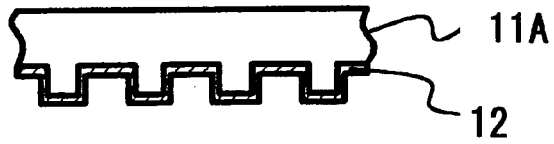

Next, as shown in FIG. 3*b*, a nontransmissive film 12 of metal is formed on the whole underside surface of the blank 11A by metal vacuum deposition into such a thickness that the sunbeam does not transmit the film, that is over 1000 Å.

Figure 3C:
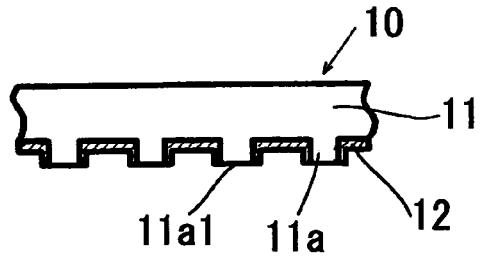

The nontransmissive film on the underside of the projection ribs 11*a* is removed by grinding to expose the underside and to flatten the surface into the underside surface 11*a*1 of the dial 10 as shown in FIG. 3*c*. Although the surface 11*a*1 is finished by grinding, the surface may be finished by cutting with a diamond tool.

In the above described method, the transmissive substrate is made by the injection molding with the mold.

Figure 4:
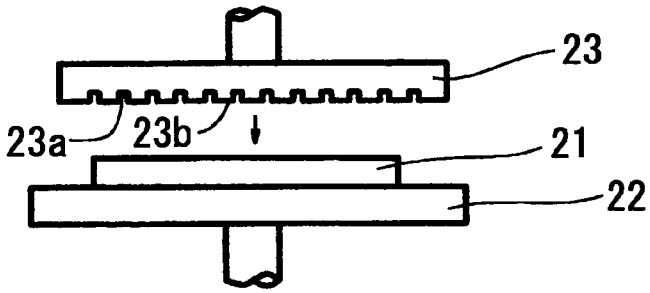
FIG. 4 shows another method for manufacturing the watch dial.

FIG. 4 shows another method for manufacturing a transmissive substrate. Namely, a transparent plastic plate 21 is mounted on a flat base 22. A pressing device 23 having a plurality of grooves 23*a* of lattice and projections on the underside thereof is pressed against the plastic plate 21 under the heating of the plate, so that a blank of a transmissive substrate which is the same as the blank 11A of FIG. 3*a*. can be obtained.

In accordance with the above described method, since the projection ribs of the transmissive substrate and recesses are formed by the mold or pressing device, the projection and recess can be formed with high accuracy. In addition, the mold or pressing device can be used in a long period, and the substrate can be formed in a short time. Therefore, the method is superior in mass productivity and possible to reduce the manufacturing cost.

The nontransmissive coating and removing process is carried out by simple metal vaporization or painting and grinding in a short time, which further causes the manufacturing cost to reduce.

Furthermore, since the stripping agent and etching agent are not used, there is no ill effect to the human body.

Although the projection ribs and recesses are formed on the underside of the substrate, these patterns may be formed on the upper surface of the substrate. This arrangement also has the same effect as the above example.

Figure 5:
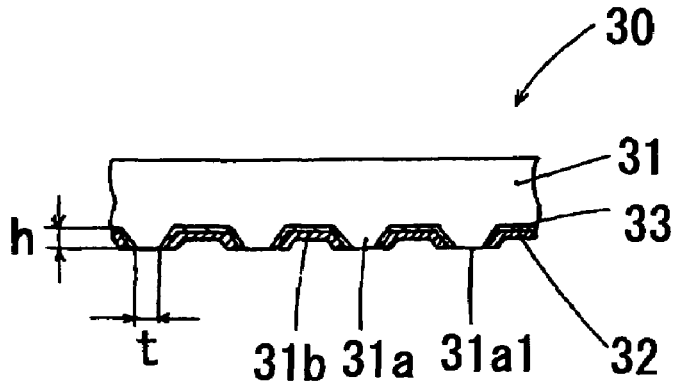
FIG. 5 is an enlarged sectional view of a watch dial according to a second embodiment of the present invention.

The second embodiment of the present invention is described with reference to FIGS. 5 and 6.

A dial 30 comprises a transmissive substrate 31 having a plurality of projection ribs 31*a* and grooves 31*b* at the underside thereof, a transmissive decoration color film 33 formed in the groove 31*b*, and a nontransmissive white film 32 formed on the color film 33.

Figure 6:
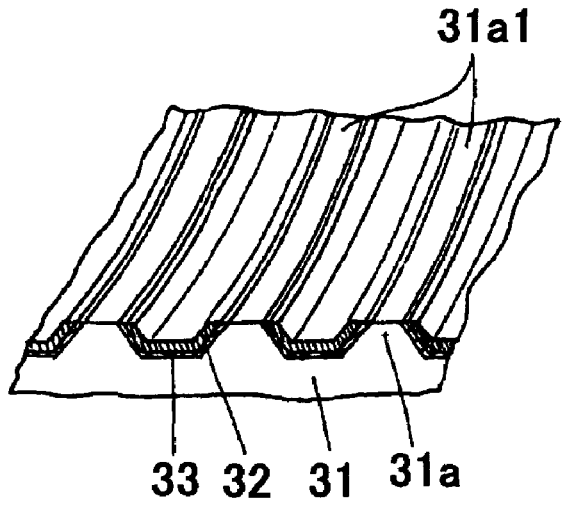
FIG. 6 is an enlarged perspective view of the dial as viewed from the underside thereof.

The projection rib 31*a* has a trapezoid section, and projection ribs 31*a* and grooves 31*b* are arranged in a concentric circle as shown in FIG. 6. The underside surface 31*a*1 of the projection rib 31*a* is grinded into a flat surface to expose the transmissive substrate 31.

The height h of the projection rib 31*a* is at least higher than 10 μm, and the width t is 70 μm or less similarly to the first embodiment. The total area of the flat underside surface 31*a*1 is in a range between 20% and 50% of the area of the upper surface of the substrate 31.

The transmissive decoration color film 33 is provided for adding a decorative color effect to the dial. Although the film 33 is formed by metal vacuum deposition into a very thin film, the film may be formed by color painting.

The nontransmissive film 32 maybe formed by metal vacuum deposition. The combination of the metal vacuum deposition for the transmissive decoration color film 33 and the white paint for the nontransmissive film 32 gives a metal feeling to a user and increases the decorative effect. Further, the combination of the paint for the transmissive decoration color film and the metal for the nontransmissive film also gives a metal feeling and increases the decoration effect.

Figure 7A:
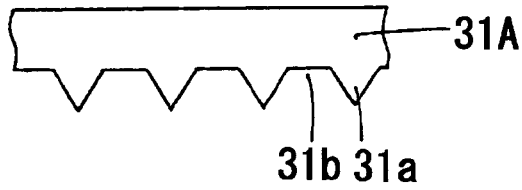
FIGS. 7*a* to 7*d* show a method for manufacturing the watch dial.
Figure 7B:
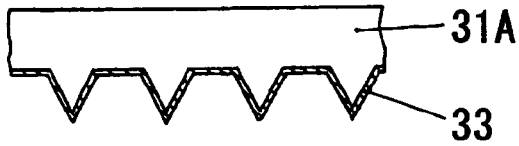

A manufacturing method for the dial 30 will be described hereinafter. FIG. 7*a* shows a blank 31A of the transmissive plastic substrate 31 formed by injection molding. On the underside of the blank 31A, grooves 31*b* and projections 31*a*, each having a triangular section, are formed. As shown in FIG. 7*b*, the transmissive decoration color film 33 is formed on the underside of the blank 31A by metal vacuum deposition.

Figure 7C:
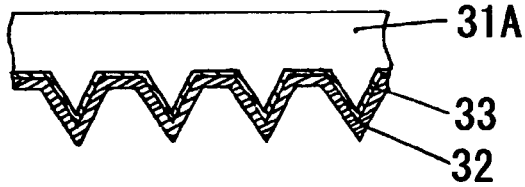
Figure 7D:
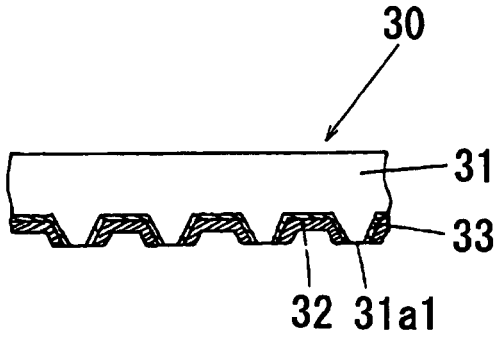

As shown in FIG. 7*c*, the nontransmissive film 32 is formed on the transmissive decoration color film 33 by white painting. Further, a lower portion of the projection 31*a* is cut off by a grinder to expose the blank 31A to finish the underside surface 31*a*1 into a flat surface. Thus, the dial 30 shown in FIG. 5 is formed.

The width t of the transmissive underside surface 31*a*l is smaller than 70 μm, so that the deep purple of the solar cell is hardly visible. In particular, when the width t is smaller than 30 μm, the purple can not be seen because the transmissive portion itself is invisible.

Since the total area of the transmissive surface 31*a*1 is set in a range between 20% and 50% of the area of the upper surface of the dial 30, a sufficient electric power is obtained.

Furthermore, since the projection 31*a* is formed into a triangular section, the size of the transmissive part 31*a*1 can be set to a desired value. Therefore, a width smaller than 30 μm is easily formed.

Figure 8:
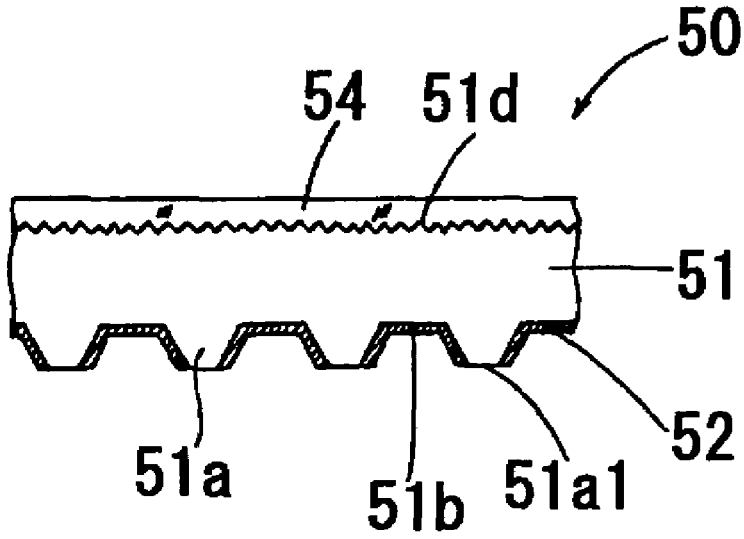
FIG. 8 is an enlarged sectional view of a watch dial according to a third embodiment of the present invention.

The third embodiment of the present invention is described hereinafter with reference to FIG. 8. A dial 50 comprises a transmissive substrate 51 having a first pattern comprising a plurality of projection ribs 51*a* and grooves 51*b* at the underside thereof, a second pattern 51*d* on the upper surface thereof, a nontransmissive film 52 formed on the grooves 51*b*, and a transparent protective film 54 formed on the second pattern 51*d*.

The projection rib 51*a* has a trapezoid section. The underside surface 51*a*1 of the projection rib 51*a* is grinded into a flat surface to expose the transmissive substrate 51. The projection ribs 51*a* and grooves 51*b* are arranged in a concentric circle as the second embodiment shown in FIG. 6.

The second pattern 51*d* has a sand pattern. The protective film 54 is formed by printing or painting a paint each as a transparent polyurethane resin and an acrylic resin in order to protect the second pattern 51*d*. The upper surface of the protective film 54 is finished to a polish flat surface by grinding.

The width of the underside surface 51*a*1 is 100 μm or less, which is slightly larger than that of the first and second embodiments. Namely, since the second pattern 51*d* is provided on the substrate 51, the deep purple of the solar cell is hardly visible even if the underside surface has a width of 100 μm. In particular, if the second pattern 51*d* is formed into a fine pattern, the deep purple can not be seen.

The total area of the flat underside surface 51*a*1 is in a range between 20% and 50% of the area of the upper surface of the substrate 51. Therefore, the quantity of light necessary for the power generation can be obtained. On the other hand, since the color of the transparent protective film 54 is remarkable, the deep purple of the solar cell is hardly seen.

In accordance with the present embodiment, the second pattern 51*d* is visible in color of the nontransmissive film 52.

Figure 9A:
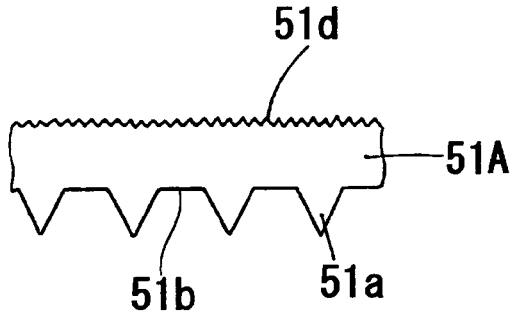
FIGS. 9*a* to 9*d* show a method for manufacturing the watch dial.
Figure 9B:
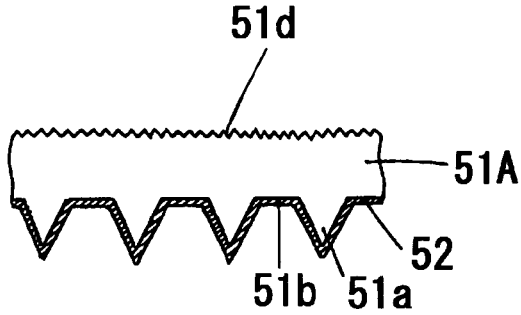

The manufacturing method for the dial 50 will be described hereinafter. FIG. 9*a* shows a blank 51A of the transmissive plastic substrate 51 formed by injection molding. On the underside of the blank 51A, grooves 51*b* and projection ribs 51*a*, each having a triangular section, are formed, and the second pattern 51*d* is formed on the upper surface. As shown in FIG. 9*b*, the nontransmissive film 52 is formed on the underside of the blank 51A by metal vacuum deposition.

Figure 9C:
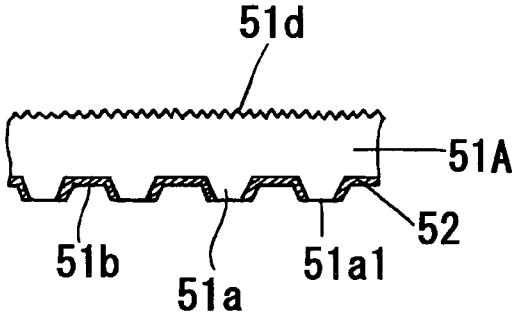
Figure 9D:
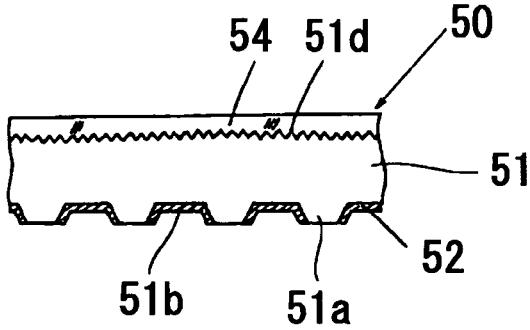

As shown in FIG. 9*c*, a lower portion of the projection rib 51*a* is cut off by a grinder to expose the blank 51A to finish the underside surface 51*a*1 into a flat surface. Next, the transparent protective film 54 is formed on the second pattern 51*d* by printing or painting. The surface of the protective film 54 is finished into a flat surface by grinding. Thus, the dial 50 is formed.

Figure 10:
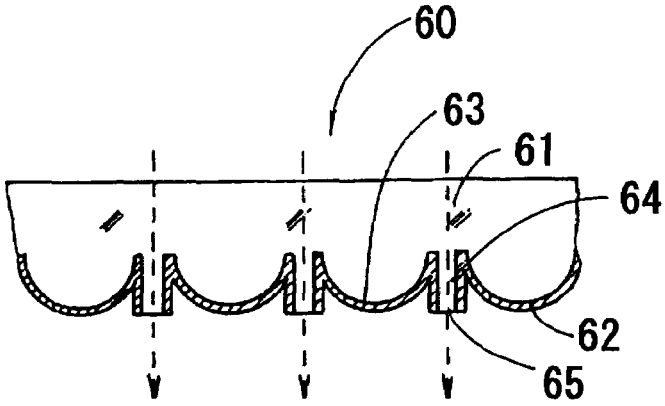
FIG. 10 is an enlarged sectional view of a watch dial according to a fourth embodiment of the present invention.
Figure 11:
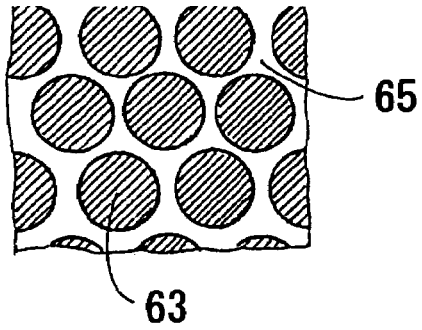
FIG. 11 is a plan view of the dial as viewed from the underside thereof.

FIG. 10 is a sectional view of the fourth embodiment of the present invention. A dial 60 for a watch comprises a transmissive plastic substrate 61 having a plurality of semispherical protrusions 63, and a projection rib 64 formed between semispherical protrusions 63. The spherical surface of the semispherical protrusion 63 and side walls of the projection rib 64 are coated with a metal reflecting film 62 except a light transmissive surface 65 of the undersurface of the projection rib 64.

The diameter of the semispherical protrusion is preferably between 50~150 μm. If the diameter is smaller than 50 μm, it is difficult to make a mold for the substrate. When the diameter is larger than 150 μm, the projection 63 becomes visible, aggravating the appearance of the dial.

Figure 14:
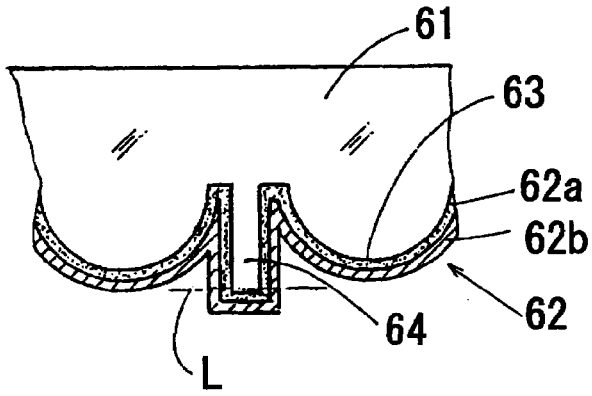

The reflecting film 62 is composed by a two-layer reflecting film comprising a silver vacuum deposition film 62*a* and a chromium vacuum deposition film 62*b* for preventing the silver film 62*a* from discoloring as shown in FIG. 14. The thickness of the silver vacuum deposition film 62*a* is about 600~1000 Å and the thickness of the chromium vacuum deposition film 62*b* is about 300~500 Å.

Instead of the chromium vacuum deposition film 62*b*, a resin paint may be printed to form a protective film.

The light transmissive surface 65 is formed by grinding the underside of the projection rib 64.

The method for manufacturing the dial 60 will be described hereinafter.

Figure 12:
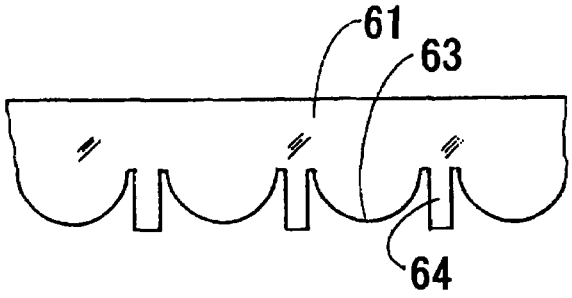
FIGS. 12 to 14 show a method for manufacturing the watch dial.

As shown in FIG. 12, the plastic substrate 61 having the semispherical protrusions 63 and the projection rib 64 is formed by injection molding or hot press. The surface of the semispherical protrusion 63 is finished into a mirror surface.

Figure 13:
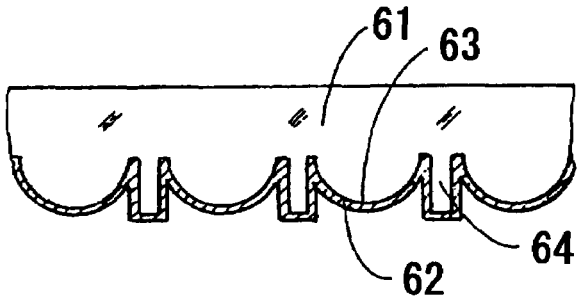

The metal reflecting film 62 is formed on the underside of the substrate 61 by vacuum deposition as shown in FIG. 13. The reflecting film 62 comprises the silver vacuum deposition film 62*a* and chromium vacuum deposition film 62*b* as shown in FIG. 14. The reflecting film 62 is not necessarily formed by double-layer. If a metal having corrosion resistivity such as gold is used, the film may be formed by a single layer.

The metal reflecting film 62 on the projection rib 64 is removed by cutting or grinding at a line L of FIG. 14 to form the light transmissive surface 65.

The area of the light transmissive surface 65 is set in a range between 20 and 50% of the area of the dial.

The metal reflecting film 62 formed on the semispherical protrusions 63 having a mirror surface has also a mirror surface to further increase the light reflection rate, so that the dial brightens brilliantly due to the reflection effect of light. The deep purple of the solar cell can not further be seen because of the reflex from the metal reflecting film 62.

Figure 15:
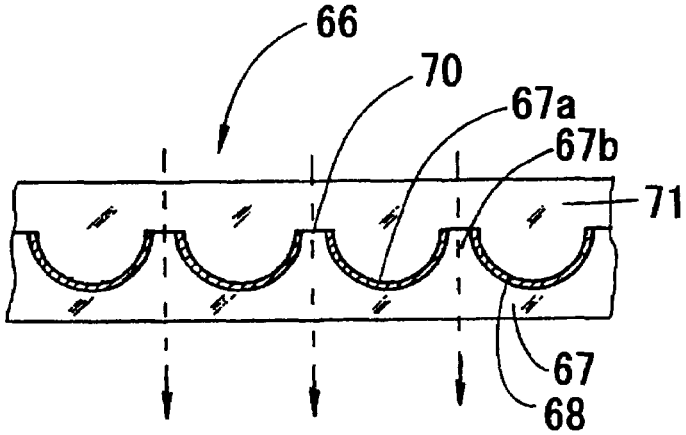
FIG. 15 is a sectional view of a watch dial according to a fifth embodiment of the present invention.

FIG. 15 is a sectional view of the fifth embodiment of the present invention. A dial 66 for a watch comprises a transmissive plastic substrate 67 having a plurality of semispherical recesses 67*a*, and a projection rib 67*b* formed between semispherical recesses 76*a*. The spherical surface of the semispherical recess 67*a* and sidewall of the projection rib 67*b* are coated with a metal reflecting film 68 except a light transmissive surface 70 of the projection rib 67*b*. The upper surface of the plastic substrate 67 is covered by a transparent resin layer 71 as a protection film.

The diameter of the semispherical recess is preferably between 50~150 μm similarly to the fourth embodiment.

The reflecting film 68 is formed by silver vacuum deposition.

The method for manufacturing the dial 66 will be described hereinafter.

Figure 16:
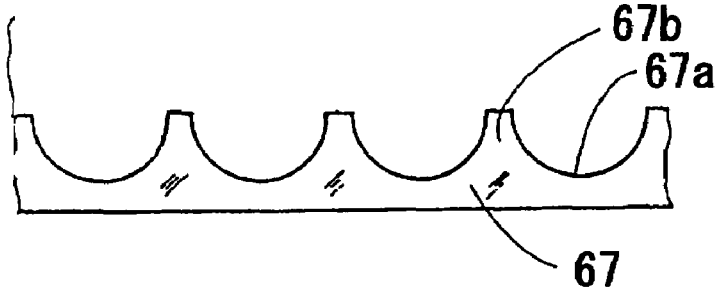
FIGS. 16 to 18 show a method for manufacturing the watch dial.

As shown in FIG. 16, the plastic substrate 67 having the semispherical recesses 67*a* and the projection rib 67*b* is formed by injection molding or hot press. The surface of the semispherical recess 67*a* is finished into a mirror surface.

Figure 17:
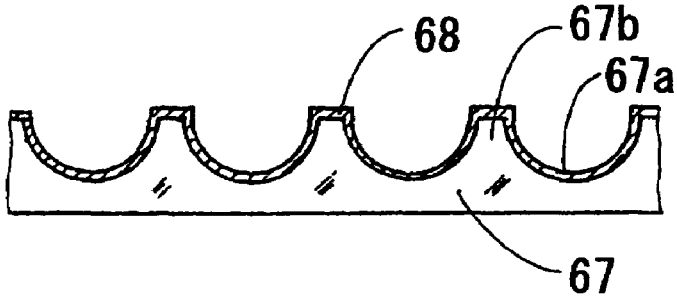

The silver reflecting film 68 is formed on the semispherical recesses 67*a* and the projection rib 67*b* of the substrate 67 by vacuum deposition as shown in FIG. 17.

Figure 18:
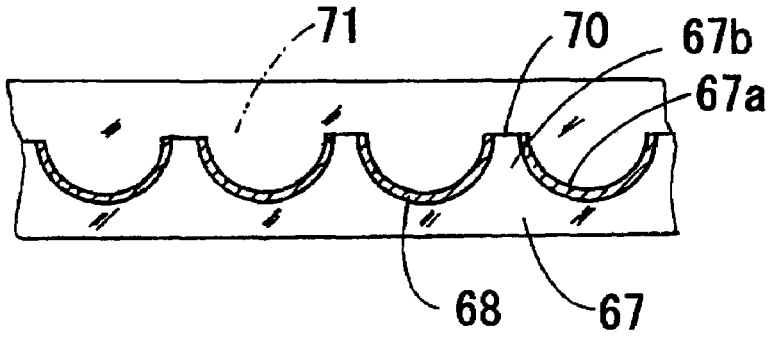

The metal reflecting film 68 on the projection rib 67*b* is removed by cutting or grinding to form the light transmissive surface 70. Furthermore, the transparent resin layer 71 is formed on the metal reflecting film 68 by printing or painting as shown in FIG. 18.

The metal reflecting film 68 formed on the semispherical recess 67*a* having a mirror surface has also a mirror surface to further increase the light reflection rate, so that the dial brightens brilliantly due to the reflection effect of light. The deep purple of the solar cell can not further be seen because of the reflex from the metal reflecting film 68.

Figure 19:
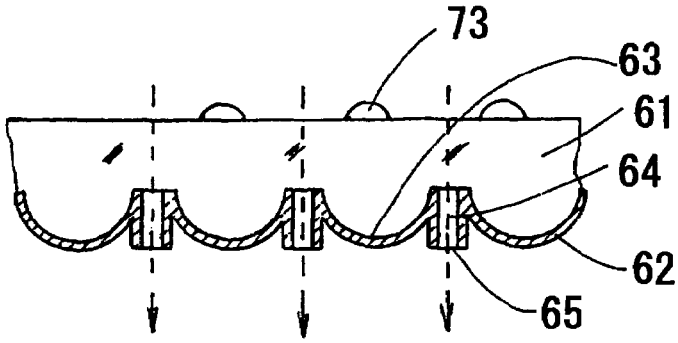
FIG. 19 is a sectional view of a watch dial according to a sixth embodiment of the present invention.

FIG. 19 is a sectional view of the sixth embodiment of the present invention. There is provided a plurality of small convex lenses 73 on the plastic substrate 61 of the fourth embodiment. The small convex lenses 73 are formed at the same time as the semispherical recesses 63 by the injection molding.

Figure 20A:
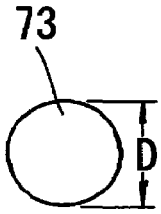
FIGS. 20*a* and 20*b* are plan views each showing a small convex lens.
Figure 20B:
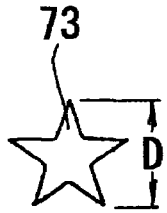

The small convex lens 73 may be shaped into various shapes such as a circle shown in FIG. 20*a*, star shown in FIG. 20*b*, polygon (not shown) and others. The size D of the convex lens 73 is about 50~200 μm, and the width thereof is larger than 10 μm. The convex lenses are disposed in matrix at an interval approximately equal to the size.

It is difficult to reduce the size less than 50 μm because of too small to make a mold for the lens. On the other hand, if the size is larger than 200 μm, the lens becomes visible, which renders the appearance of the dial unpreferable.

If the thickness of the convex lens 73 is less than 10 μm, refraction and dispersion effect reduces, hence the brightness disappears.

The small convex lens 73 may be formed by printing after the forming of the dial. The printed lens has a semi-ellipse section.

Figure 21:
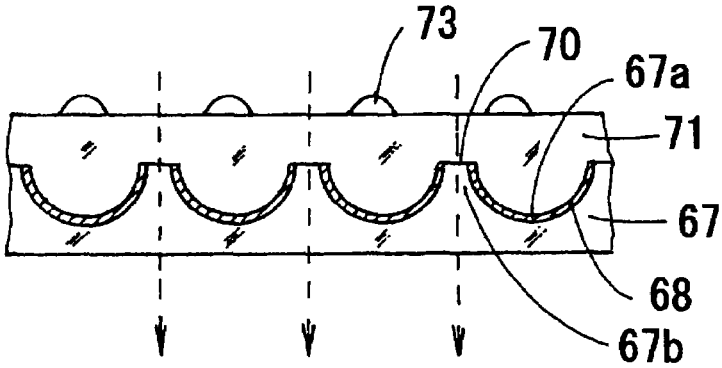
FIG. 21 is a sectional view showing a watch dial according to a seventh embodiment of the present invention.

FIG. 21 is a sectional view showing the seventh embodiment of the present invention. There is formed a plurality of small convex lenses 73 on the transparent resin layer 71 in the fifth embodiment. Since the small convex lens 73 is the same as the small convex lens 73 of the sixth embodiment, the explanation for the lens is omitted.

Figure 22:
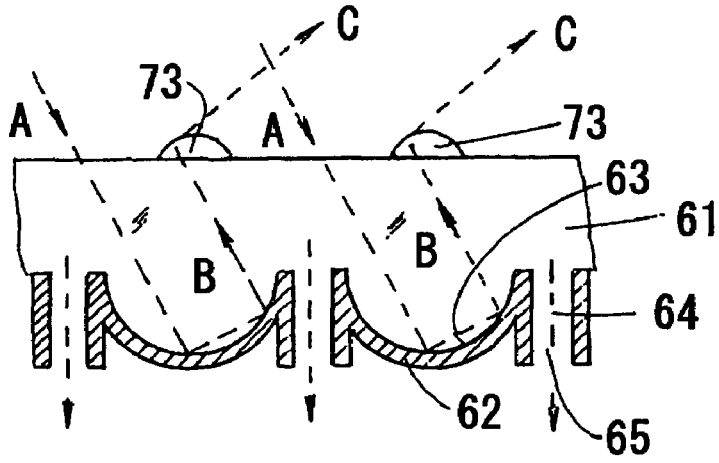
FIG. 22 is an illustration for explaining the condition of refraction in the dial by the small convex lens.

FIG. 22 is a sectional view of the dial of the sixth embodiment shown in FIG. 19 for explaining the condition of refraction in the dial. Light A entered in the plastic substrate 61 is reflected by the metal reflecting films 62 under the semispherical convex lenses 63 and condensed by the spherical surface. The reflected light B is refracted and dispersed at various angles by the small convex lenses 73 to provide a bright surface.

Figure 23:
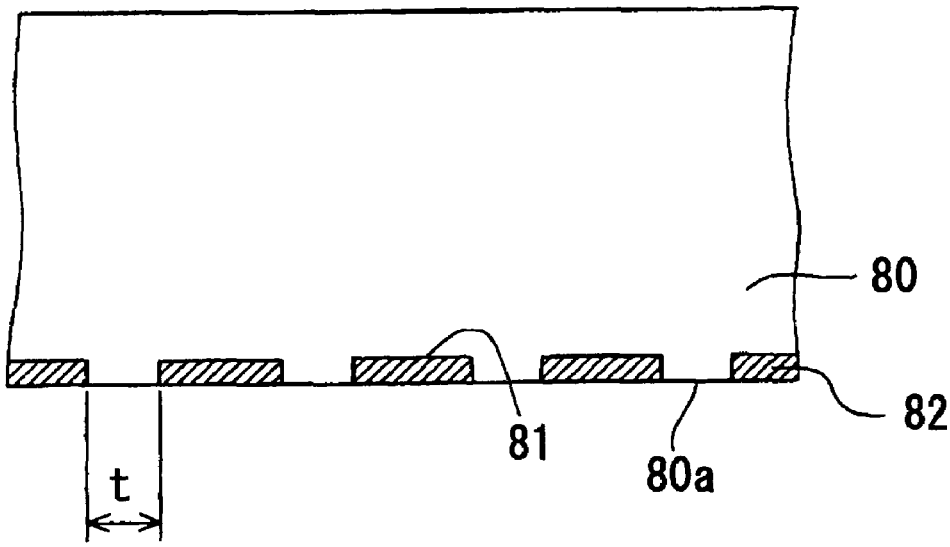
FIG. 23 is a sectional view of a watch dial according to an eighth embodiment of the present invention.

FIG. 23 is a sectional view showing eighth embodiment of the present invention. A transmissive plastic substrate 80 has a plurality of recesses 81 on the underside thereof arranged in matrix. The bottom of the recess 81 is finished into a mirror surface, and a reflecting film 82 is formed in the recess 81. The reflecting film 82 has such a thickness as not to transmit light. The underside surface of the substrate other than the recesses 81 is finished to a flat surface to form a transmissive portion 80*a*.

Figure 24:
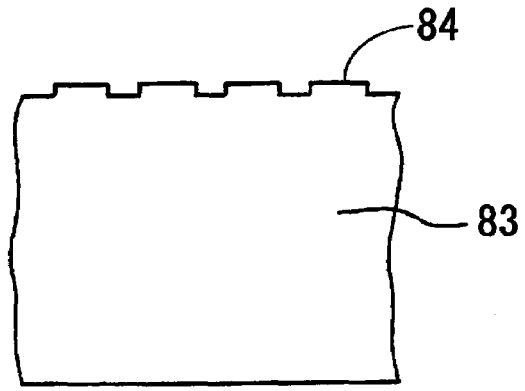
FIG. 24 is an enlarged sectional view of a mold for molding a substrate of the watch dial.

The method for manufacturing the dial is described hereinafter. FIG. 24 shows a mold 83 for molding the substrate 80. There is provided a plurality of projections 84. The upper surface of the projection 84 is finished into a mirror surface. A dial blank is formed by injecting a transmissive plastic in the mold 83. A reflecting film is formed on the whole surface where the recesses 81 are formed by the projections 84. When the film is formed by metal vacuum deposition, the thickness larger than 1000 Å is set so as not to transmit light. Then, the film formed on the upper surface of the projections is removed to expose the surface of the substrate. The exposed surfaces of the substrate are finished into the flat transmissive portions 80*a*.

In accordance with the present embodiment, the bottom of the recess 81 is formed into a mirror surface by the mirror upper surface of the projection 84, so that the reflecting rate becomes large. Therefore, even if the width t of the transmissive portion 80*a* is increased to 120 μm, the transmissive portion 80*a* is invisible, and hence the deep purple of the solar cell can not be seen.

The following table shows results of an experiment wherein the width t of the transmissive portion 80*a* is changed to obtain observation results.

| t μm | Observation | Decision |
|---|---|---|
| 70 | Invisible | ○ |
| 80 | Invisible | ○ |
| 90 | Invisible | ○ |
| 100 | Invisible | ○ |
| 110 | Invisible | ○ |
| 120 | Invisible | ○ |
| 130 | Slightly Visible | Δ |

The transmissive portion 80*a* can not be seen when the width t is smaller than 130 μm. When the width t is 130 μm, the transmissive portion 80*a* is slightly visible.

Figure 25:
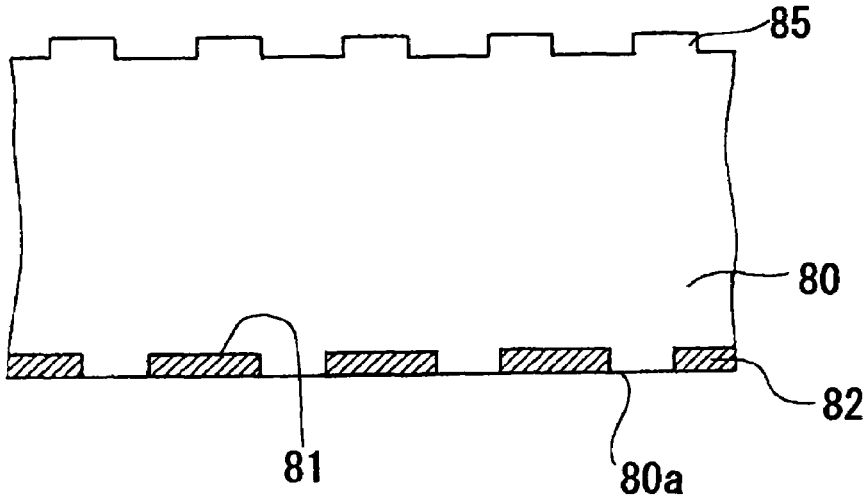
FIG. 25 is a sectional view of a watch dial according to a ninth embodiment of the present invention.

FIG. 25 is a sectional view of the ninth embodiment of the present invention. In the embodiment, a pattern 85 comprising plurality of projections and recesses is formed on the upper surface of the transmissive substrate 80 of the eighth embodiment. Other parts are the same as FIG. 23, and the explanation thereof is omitted by identifying with the same reference numerals as FIG. 23.

The pattern 85 disperses, scatters and radiates the light reflected from the solar cell. As a result, the solar cell becomes further invisible by the dispersed and scattered light. If the upper surface and lower surface are different in pattern, the reflected light from the solar cell is dispersed in different direction. Consequently, the deep purple of the solar cell is completely invisible.

While embodiments for the solar cell have been described, the present invention may be applied to a watch dial having a back light such as electroluminescence on the underside thereof. Since the transmissive portion is invisible, the electroluminescence is completely invisible. Further, transmissive portion can be increased in size. Therefore, a large quantity of light is extracted, so that the dial may be brightly illuminated.

Figure 26:
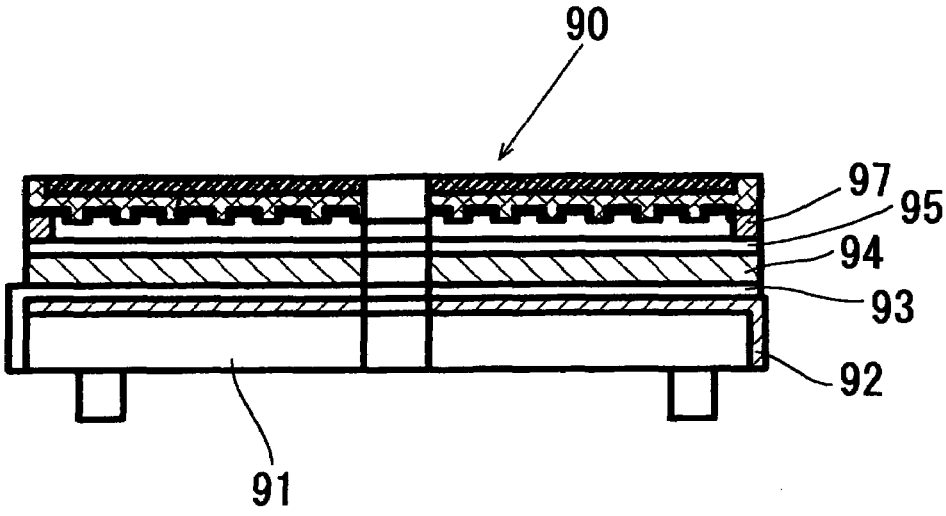
FIG. 26 is a sectional view of a watch dial according to a tenth embodiment of the present invention.

FIG. 26 is a sectional view of the tenth embodiment of the present invention.

A watch dial 90 has a substrate 91, and an insulation film 92, an electrode film 93, a solar cell 94, a transparent electrode 95 which are formed in order on the substrate 91. The dial 90 is mounted on the transparent electrode 95 through a spacer 97.

Figure 27:
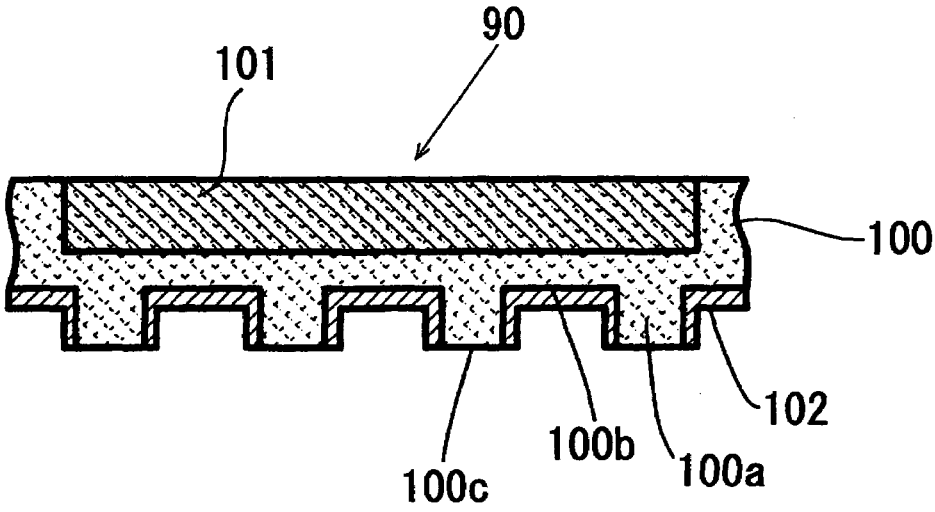
FIG. 27 is an enlarged view of the dial of the tenth embodiment.

Referring to FIG. 27 showing a sectional view of the dial, the dial 90 comprises a transmissive substrate 100 made of a transparent polycarbonate resin in which an ultraviolet rays absorbent is compounded. On the transmissive substrate 100, a color picture layer 101 is formed by soaking a sublimating dye.

The ultraviolet rays absorbent comprises zinc oxide of fine-grain. The zinc oxide of 1 part by weight is mixed in the transparent polycarbonate resin of 100 parts by weight. The zinc oxide has superior ultraviolet rays absorbing quality. Since zinc oxide is transparent, the color picture layer 101 is not effected by it. Furthermore, since zinc oxide is superior in antibacterial quality, the color picture layer 101 has a good sanitary effect on the uppermost surface of the dial.

The upper surface of the transmissive substrate 100 is finished into a flat and smooth face. The undersurface of the substrate 100 has a plurality of recesses 100*b* and projections 100*a* arranged in a pattern, the recessed 100*b* are disposed in matrix. The bottom of the recess 100*b* is finished into a mirror surface, and the inside wall of the recess is coated with a metal reflecting film 102.

The underside surface 100*c* of the projection 100*a* is grinded to expose a part of the substrate 100, and finished into a smooth face to provide a light transmissive portion. Namely, the composition of the substrate 100 is the same as the first embodiment.

The width of the underside surface 100*c* is 120 μm or below. The total area of the underside surface 100*c* is in a range between 20~50% of the area of the upper surface of the transmissive substrate 100.

The metal reflecting film 102 on the inside wall of the recess 100*b* is formed by metal vacuum deposition to such a thickness as not to transmit light beam.

Light beam does not pass through the reflecting film 102 and is reflected, so that the color of the film 102 is visible. On the other hand, the light passes through the underside surface 100*c*, and is injected in the solar cell 94 disposed under the substrate 100 at a high injection rate without scattering because of the flat and smooth surface of the underside surface 100*c*.

In accordance with the present embodiment, since the reflecting film 102 on the recess 100*b* is formed into a mirror face, reflecting rate is increased. Consequently, even if the width of the underside surface 100*c* is increased to 120 μm, the deep purple of the solar cell can not be seen.

Although the color layer 101 is provided on the substrate 100, a majority of injected light beam passes through the substrate 100 by finishing the underside surface 100*c* into a flat and smooth surface. Thus, a colorful watch dial may be provided by the color picture layer 101.

Figure 28A:
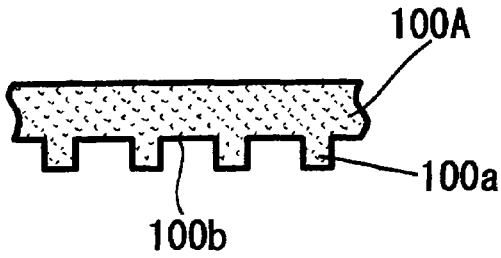
FIGS. 28*a* to 28*d* show a method for manufacturing the watch dial of the tenth embodiment.

A manufacturing method of the dial 90 will be described with reference to FIGS. 28*a* through 28*d*. As shown in FIG. 28*a*, a substrate blank 100A having recesses 100*b* and projections 100*a* is formed by injecting a transmissive resin in a mold under heating and pressurizing. In order to finish the bottom of the recess 100*b* into a flat and smooth face, the projection of the mold is finished into a mirror surface. The transmissive resin for the substrate blank is a transparent polycarbonate resin in which zinc oxide is mixed at a proportion of 1 part by weight to 100 parts by weight.

Figure 28B:
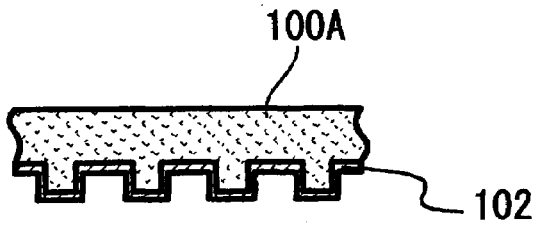

Next, the reflecting film 102 is formed on the underside of the blank 100A by metal vacuum deposition as shown in FIG. 28*b*. The reflecting metal film 102 is formed into a thickness so as not to transmit a light beam (about 1000 Å or more).

Figure 28C:
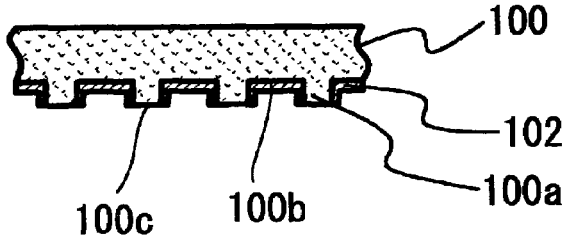

As shown in FIG. 28*c*, the underside of the projection 100*a* is grinded to expose the transmissive substrate 100 to finish into a flat and smooth face.

Figure 28D:
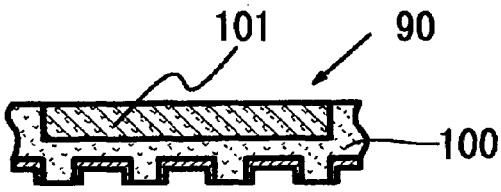
Figure 29:
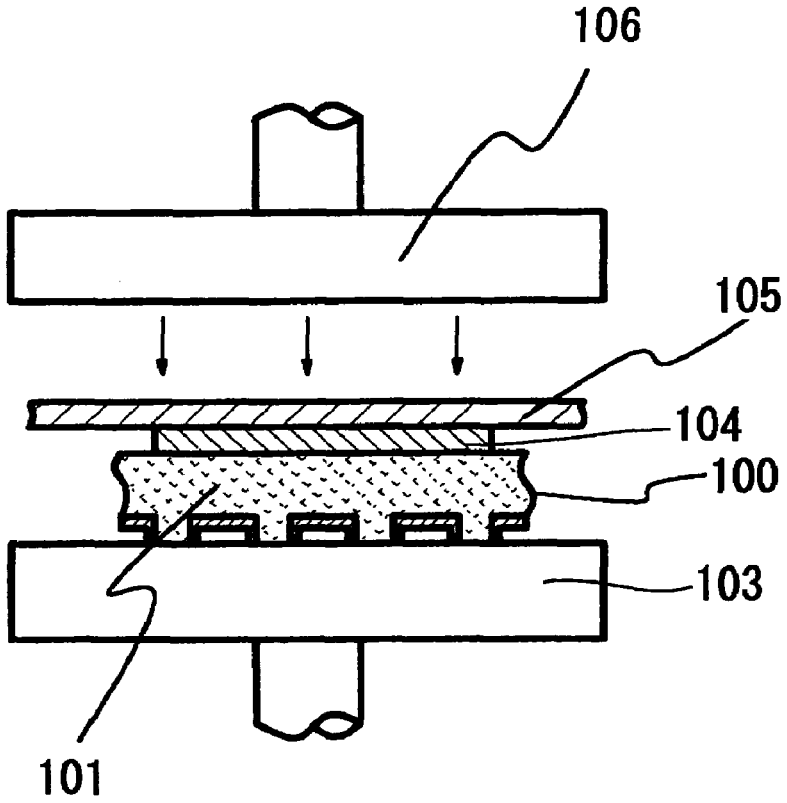
FIGS. 29 and 30 show a method for forming a picture on a dial with a transcription paper.
Figure 30:
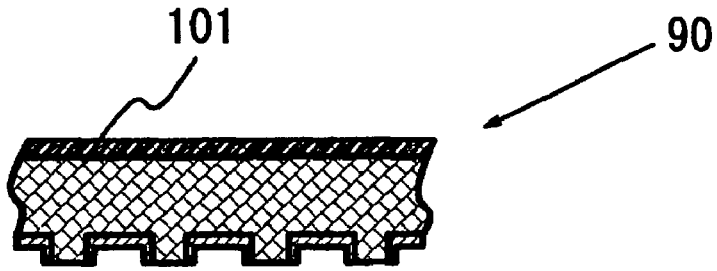

Referring to FIG. 29, the transmissive substrate 100 is mounted on a table 103, and a transcription paper 105 on which a color picture 104 is formed by printing a sublimating dye ink is mounted on the substrate. Next, the transmissive substrate 100 is pressed by a pressing plate 106 at temperature of 180° C. and under pressure of 10 g/cm$^2$ for one minute, so that the sublimating dye on the transcription paper 105 is vaporized. Thus, the sublimating dye is soaked into the substrate 100 to be formed into the color layer 101 as shown in FIGS. 30 and 28*d*.

Figure 31:
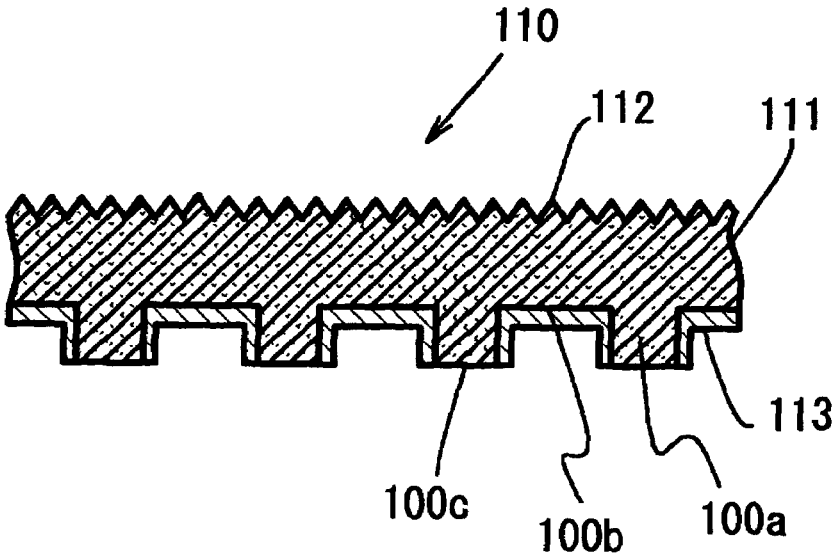
FIG. 31 is an enlarged sectional view of a watch dial according to an eleventh embodiment.

FIG. 31 is a sectional view of the eleventh embodiment.

A transmissive substrate 111 of a watch dial 110 has a sand pattern 112 on an upper surface thereof and a reflecting film 113 on the underside. The reflecting film 113 is formed by paint. The whole of the substrate is colored by soaking a sublimating dye in the substrate. Other portions are the same as the tenth embodiment, and identified by the same reference numerals as FIG. 27, the explanation thereof being omitted.

The reflecting film 113 is formed into a thickness so as not to pass light. The sand pattern 112 is different from the pattern of projections 100*a*. The sand pattern 112 disperses injected light in various directions, rendering the deep purple of the solar cell invisible.

A method of manufacturing the dial 110 will be described hereinafter.

Figure 32A:
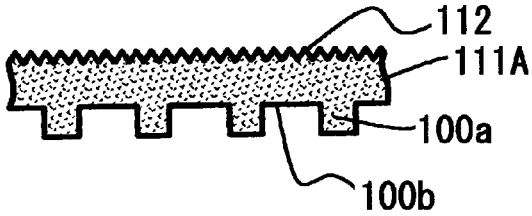
FIGS. 32*a* to 32*d* show a method for manufacturing the watch dial of the eleventh embodiment.

Referring to FIG. 32*a*, a blank 111A of the transmissive substrate 111 is formed by injecting a transparent polycarbonate resin in a mold, thereby forming projections 100*a*, recesses 100*b* and sand pattern 112. In the polycarbonate resin of 100 parts by weight, zinc oxide of 1 part by weight is mixed as an ultraviolet rays absorbent.

Figure 32B:
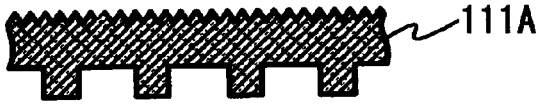

As shown in FIG. 32*b*, the blank 111A is colored. The coloring is performed by soaking the blank in a sublimating dye at temperature of 110° C. and for 1 minute, after washing and drying of the blank, by pressing the upper surface of the blank under temperature of 180° C. and pressure 10~20 g/cm$^2$.

In the condition that the blank is soaked in the sublimating dye, soaking of the dye in the blank is shallow and becomes deep by heating and pressing.

Solution for the sublimating dye is prepared by mixing a plastic sublimating dye having affinity to the dye. In the present embodiment, the solution is prepared by compounding a sublimating dye of 4 parts by weight with a polyester resin of 100 parts by weight. The solution is heated at the temperature between 100 and 120° C. and soaked in the blank for 1-3 minutes.

Figure 32C:
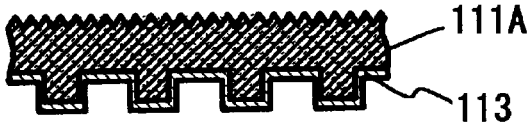
Figure 32D:
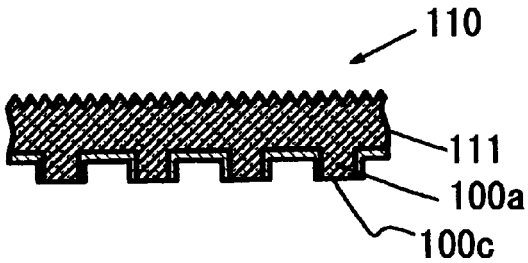

Next, the reflecting film 113 of paint film is formed on the underside of the blank 111A as shown in FIG. 32*c*. Thereafter, the underside of the projection 100*a* is grinded or cut to expose the blank 111A and finished into a flat and smooth surface 100*c* as shown in FIG. 32*d*. By coloring the substrate as described above, the dye is deeply soaked into the substrate so that the dye provides a high resistivity to the ultraviolet rays.

The above described manufacturing method of the watch dial is simple and the number of manufacturing steps is small. Therefore, it is possible to manufacture the dial at a low cost. In particular, the soaking coloring method is briefly carried out, reducing the manufacturing cost.

As another ultraviolet rays absorbent, titanium oxide has the same effect as zinc oxide. Further, an ultraviolet rays absorbent represented by the formula (1) may be used.

(1)

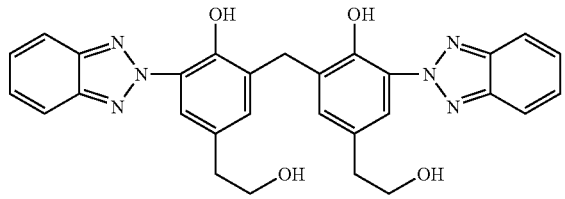

In use of the ultraviolet rays absorbent the absorbent of 2.5 parts by weight is compounded with the substrate polycarbonate resin of 100 parts by weight.

Figure 33:
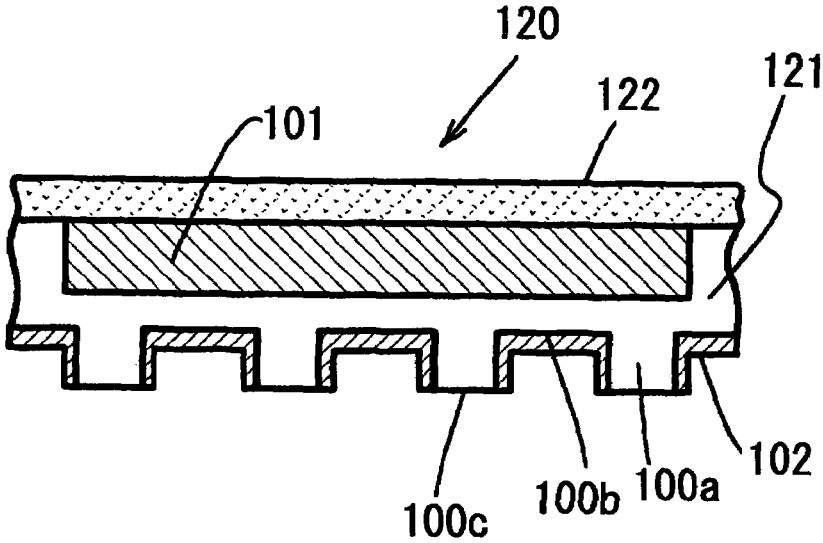
FIG. 33 is an enlarged sectional view of a watch dial provided with a protector film according to a twelfth embodiment of the present invention.

FIG. 33 is a sectional view of the twelfth embodiment of the present invention.

A transmissive substrate 121 of a watch dial 120 has a transparent protector film 122 on the upper surface thereof. An ultraviolet rays absorbent is compounded with the protector film 122. Other parts are the same as the dial of FIG. 27 and the same reference numerals are used as FIG. 27.

The transparent protector film 122 is formed into a thickness of 20 μm by a paint. The paint is prepared by compounding an ultraviolet rays absorbent of 2-(3-t-butyl-5-methyl-2-hydroxyphenyl)-5-chlorobenzotriazole of 2.5 parts by weight, which is represented by the formula (2) with a transparent polyurethane resin of 100 parts by weight.

(2)

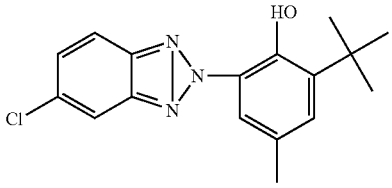

The transparent protector film 122 is provided for protecting the color layer 101, and formed by printing or painting a transparent urethane paint or acryl paint. The upper surface of the protector film 122 is finished into a flat and smooth luster face. The protector film has a thickness between 10 and 30 μm .

A method for manufacturing the watch dial 120 is described hereinafter.

Figure 34A:
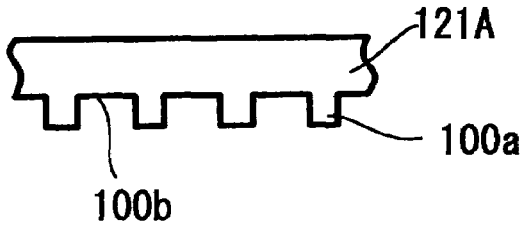
FIGS. 34*a* to 34*e* show a method for manufacturing the watch dial of the twelfth embodiment.

FIG. 34*a* shows a blank 121A of the transmissive substrate 121 formed by injection molding.

Figure 34B:
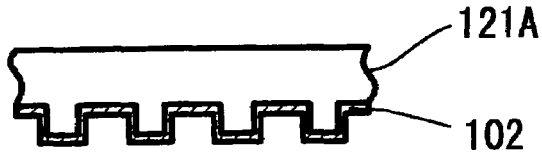

Next, the reflecting film 102 is formed on the underside of the blank 121A by metal vacuum deposition as shown in FIG. 34*b*.

Figure 34C:
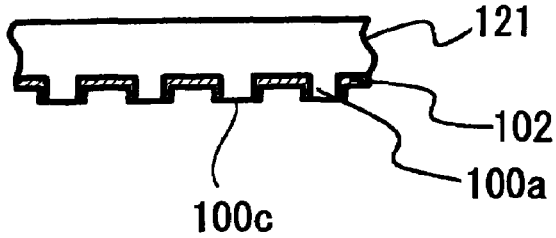

The underside of the projection 100*a* is grinded to remove the reflecting film and finished into the flat and smooth undersurface 100*c* as shown in FIG. 34*c*.

Figure 34D:
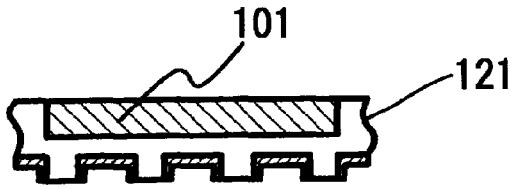

Next, as shown in FIG. 34*d*, the color layer 101 is formed on the upper surface of the substrate 121 by soaking the sublimating dye.

Figure 34E:
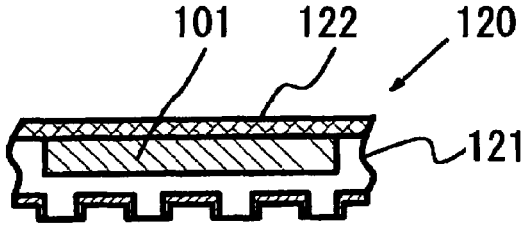
Figure 35:
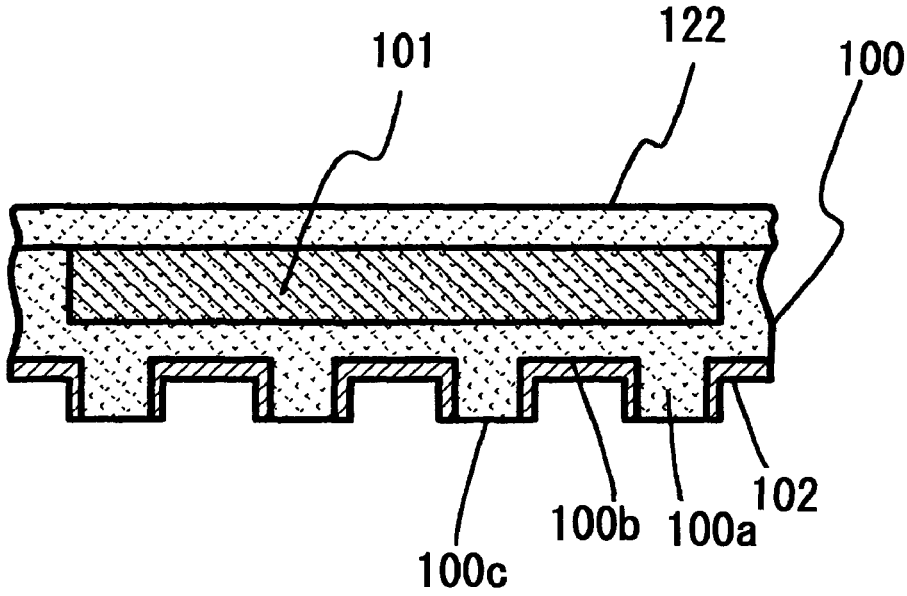
FIG. 35 is an enlarged sectional view of another example of the watch dial of the twelfth embodiment having the protector film.

Thereafter, the transparent protector film 122 is formed on the upper surface of the transmissive substrate 121 by the above described method as shown in FIG. 34*e*. The upper surface of the protector film 122 is finished into a flat and smooth face by grinding.

Figure 36:
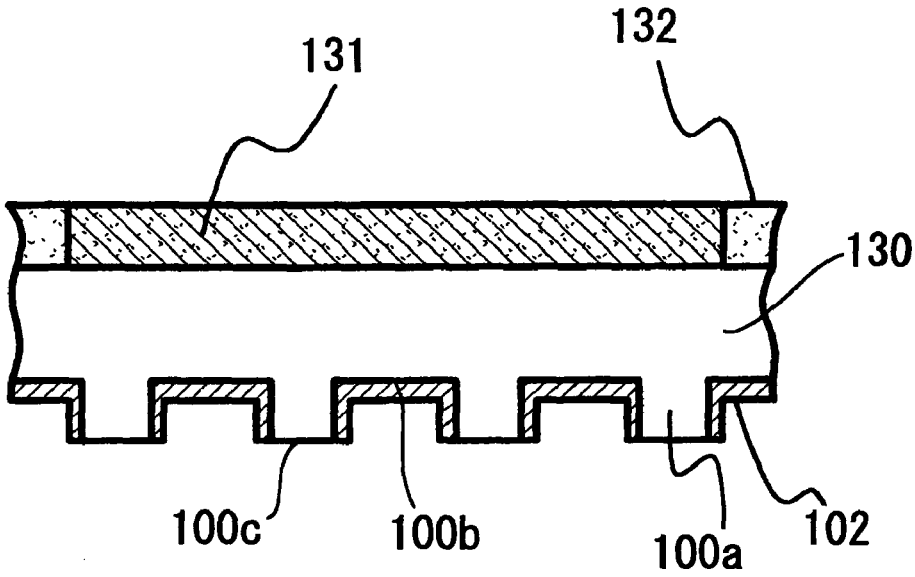
FIG. 36 is an enlarged sectional view of a watch dial provided with a retainer layer according to a thirteenth embodiment of the present invention.

FIG. 36 is a sectional view of the thirteenth embodiment of the present invention. A transmissive substrate 130 does not include an ultraviolet absorbent. A retainer layer 132 retaining a transcript color picture 131 is formed on the upper surface of the transmissive substrate 130. An ultraviolet absorbent is compounded with the retainer layer 132. Other parts are the same as FIG. 27.

The retainer layer 132 is formed into a thickness of 20 μm by a paint. The paint is prepared by compounding an ultraviolet rays absorbent of 2-(3,5-di-t-butyl-2-hydroxyphenyl) benzotriazole of 2.5 parts by weight, which is represented by the formula (3) with a transparent polyurethane resin of 100 parts by weight.

(3)

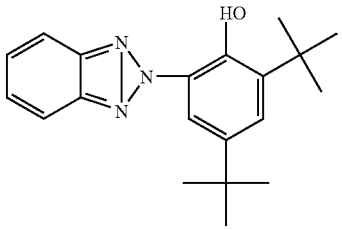

The upper surface of the retainer layer 132 is finished into a flat and smooth surface by grinding.

The ultraviolet rays absorbent takes on pale yellow in a powder state. Therefore compounding quantity of the absorbent must be in accordance with the light resistivity and the color of the retainer layer. If the compounding quantity is small, the light resistivity reduces. If the compound quantity is large, the retainer layer 132 assumes a color, so that the color of picture 131 changes, resulting in reduction of quality of the dial. It is preferable that the compound quantity is a weight proportion between 0.5 and 10 based on experimental result.

Although a polyurethane resin is used as a binder of the retainer layer 132, another resin such as polyester resin, epoxy resin, or acrylic resin may be used.

The thickness of the retainer layer 132 is very important since the thickness has an influence on the soaking depth of the sublimating dye. When the thickness is small, the dye evaporates and the picture 131 discolors. As a result of an experiment, it is preferable that the thickness is larger than 10 μm and smaller than 80 μm.

If the upper surface of the retainer layer 132 is flat and smooth, the layer is molded by a uniform pressure over the whole surface. Consequently, the picture 131 is evenly formed.

The ultraviolet rays absorbent of 2-(3,5-di-t-butyl-2-hydroxyphenyl) benzotriazole in the twelfth embodiment and the ultraviolet rays absorbent of 2-(3,5-di-t-butyl-2-hydroxyphenyl) benzotriazole in the thirteenth embodiment may be mixed and used in both embodiments. Furthermore, the ultraviolet rays absorbent of the formula (1) may be independently used or mixed in the twelfth and thirteen embodiments.

Figure 37A:
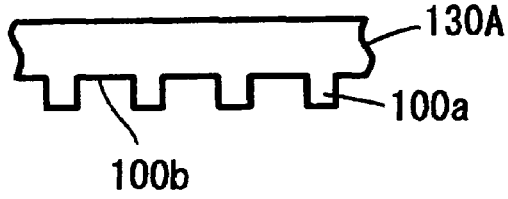
FIGS. 37*a* to 37*e* show a method for manufacturing the watch dial of the thirteenth embodiment.
Figure 37B:
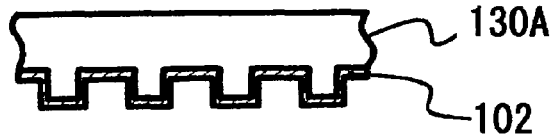
Figure 37C:
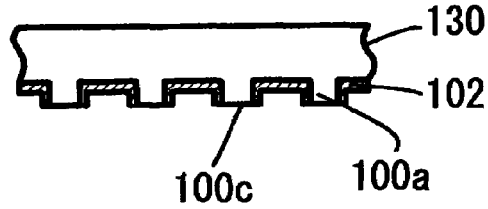

A manufacturing method for the dial will be described with reference to FIGS. 37*a* through 37*e*. Since the step of FIGS. 37*a*-37*c* are the same as the steps of FIGS. 34*a*-34*c*, the explanation thereof is omitted.

Figure 37D:
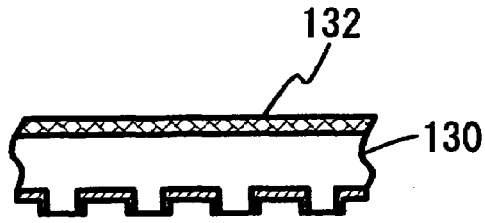

As shown in FIG. 37*d*, the retainer layer 132 is formed on the transmissive substrate 130 by printing or painting. The upper surface of the retainer layer 132 is finished into a flat and smooth face by grinding. In the formation of the retainer layer 132, the ultraviolet rays absorbent of 2.5 parts by weight is compounded to be a paint and formed into the thickness of 20 μm.

Figure 37E:
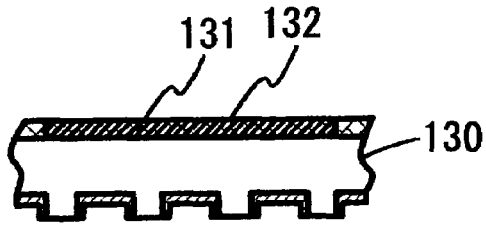

As shown in FIG. 37*e*, the color picture 131 is formed in the retainer layer 132. More particularly, the color picture 131 is formed by transcription of a picture formed on a transcription paper by printing a sublimating dye ink on the retainer layer 132 at temperature of 180° C. under pressure of 10 g/cm$^2$. This step is the same as that of the tenth embodiment.

Figure 38:
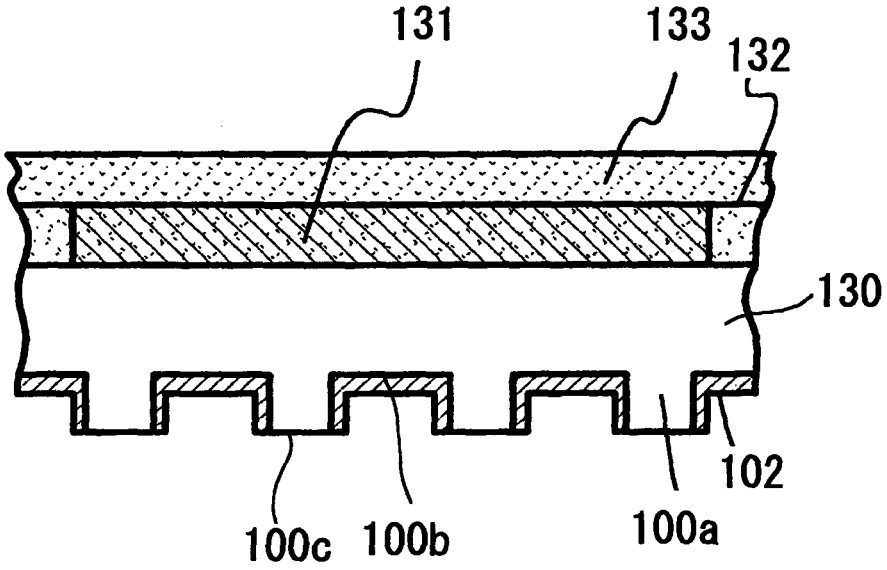
FIG. 38 is an enlarged sectional view of a watch dial provided with a retainer layer and a protector film according to the thirteenth embodiment of the present invention.

Referring to FIG. 38 showing a modification of the thirteenth embodiment, a transparent protector film 133 is formed on the watch dial of the embodiment.

Figure 39:
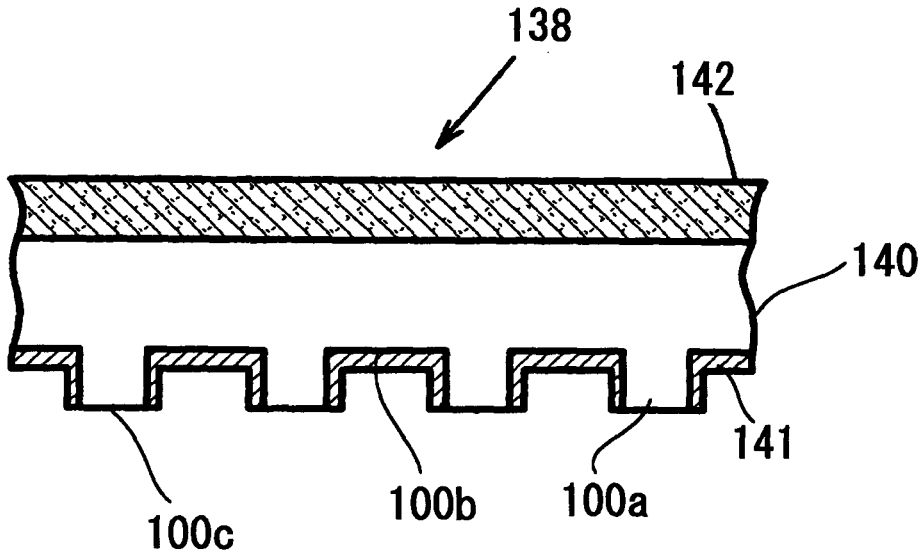
FIG. 39 is an enlarged sectional view showing a gold colored watch dial provided with a retainer layer according to a fourteenth embodiment of the present invention.

FIG. 39 is a sectional view showing the fourteenth embodiment of the present invention.

A watch dial 138 comprises a transmissive substrate 140, a metal reflecting film 141 formed on the underside of the substrate 140, and a gold retainer layer 142 formed on the upper surface of the transmissive substrate 140. The reflecting film 141 is a vacuum deposition film of silver.

The retainer layer 142 is formed by printing a paint, in which an ultraviolet absorbent is included, on the upper surface of the transmissive substrate 140. A sublimating dye is soaked in the retainer layer 142 by a hereinafter described transcription method. The retainer layer 142 is finished into a very pale gold by processing as described hereinafter.

More particularly, dots each having a size of about 1440 dpi are printed on a white transcription paper with a sublimating dye ink by an ink jet printer. The sublimating dye ink consists of a red ink and a yellow ink. The printing area of the yellow dots is about 8%, that of the red dots is about 2%, the residual white area is 90%. The yellow dots and red dots are uniformly dispersed so as not to overlap with each other.

Next, the transcription paper is mounted on the flat smooth surface of the retainer layer 142 and pressed against the retainer layer 142 under heating condition to transcript the dots to the retainer layer. In the case that the retainer layer 142 is made of polyurethane, transcription operation is carried out at temperature of about 180° C., pressure of 10 g/cm$^2$ for about 40 seconds. By the operation, the sublimating dye of the transcription paper vaporizes and soaks into the retainer layer 142 so that a desired gold color is transcribed to the retainer layer.

Figure 40:
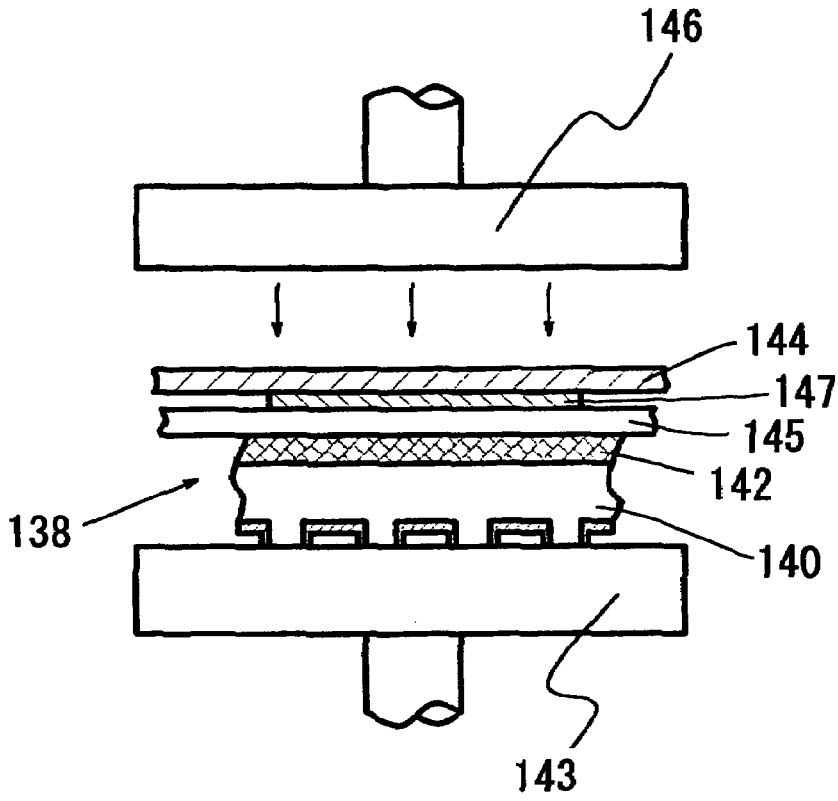
FIGS. 40 and 41 show a method for forming a picture on a dial with a transcription paper through a transmissive film sheet.

In the above described transcription operation, it may occur that dots are not sufficiently mixed, thereby deteriorating the appearance of the dial. FIG. 40 shows transcription operation for dissolving such a disadvantage.

Figure 41:
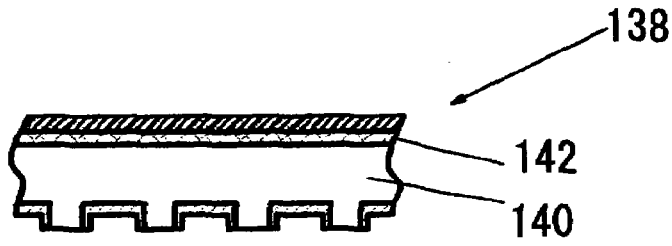

FIG. 40 shows operation for forming a color picture by transcription. FIG. 41 shows a state of the watch dial after the transcription.

Referring to FIG. 40, the watch dial 138 is mounted on a base 143. Mounted on the retainer layer 142 is a transparent film sheet 145 on which a transcription paper 144 having dots 147 printed thereon at a predetermined ratio as described above. The film sheet 145 is made of polypropylene resin, polyethylene resin, polycarbonate resin, nitrocellulose resin, nitrofreon resin, or acrylic resin, and has a flat smooth surface. The thickness of the film sheet 145 is set in a range between 25-50 μm.

A pressure device 146 presses the transcription paper 144 and the film sheet 145 against the retainer layer 142 on the substrate 140 under heating in the above described conditions. However, it is preferable to set a longer time.

In the above described transcription method, dots 147 on the transcription paper 144 soak into the film sheet 145, and further soak into the retainer layer 142. The double soaking of dots causes the dots to sufficiently mix, thereby preventing the occurrence of spots of dots. Thus, a beautiful very pale color can be obtained.

In the transcription method, the thickness of the film sheet 145 has a great influence on the quality of the gold color. It has been proved by experiments that the thickness between 25 and 50 μm is preferable. If the thickness is thinner than 25 μm, a paper pattern of the transcription paper 144 is transferred to the retainer layer 142. If the thickness is thicker than 50 μm, the dye remains in the film sheet, the gold color becomes unclear.

By finishing the upper surface of the retainer layer 142 into a flat smooth face by grinding, it is possible to transcript dots at constant pressure, thereby preventing the occurrence of uneven color. Further, since the flat smooth face of the retainer layer 142 contacts with the flat smooth film sheet 145, the flat smooth face of the retainer layer is maintained even after pressure. Thus, it is possible to finish the surface of the watch dial into a beautiful face.

Next, the setting for obtaining a pale gold will be described hereinafter. Also in this case, dots each having a size of about 1440 dpi are printed on the transcription paper with the sublimating dye ink by the ink jet printer. Printing area of the yellow dot is about 30%, printing area of the red dot is about 5%, and the white area is about 65%. The yellow dots and red dots are uniformly dispersed so as not to overlap with each other.

Next, the transcription paper is mounted on the flat smooth surface of the retainer layer 142 and pressed against the retainer layer 142 under heating condition to transcript the dots to the retainer layer. By the operation, a desired pale gold color is obtained.

Next, the setting for obtaining a pale red and gold will be described hereinafter. Also in this case, dots each having a size of about 1440 dpi are printed on the transcription paper with the sublimating dye ink by the ink jet printer. Printing area of the yellow dot is about 39%, printing area of the red dot is about 7%, and the white area is about 54%. The yellow dots and red dots are uniformly dispersed so as not to overlap with each other.

Next, the transcription paper is mounted on the flat smooth surface of the retainer layer 142 and pressed against the retainer layer 142 under heating condition to transcript the dots to the retainer layer. By the operation, a beautiful pale red and gold color is obtained.

Next, the setting for obtaining a red and gold will be described hereinafter. Also in this case, dots each having a size of about 1440 dpi are printed on the transcription paper with the sublimating dye ink by the ink jet printer. Printing area of the yellow dot is about 49%, printing area of the red dot is about 12%, and the white area is about 39%. The yellow dots and red dots are uniformly dispersed so as not to overlap with each other.

Next, the transcription paper is mounted on the flat smooth surface of the retainer layer 142 and pressed against the retainer layer 142 under heating condition to transcript the dots to the retainer layer. By the operation, a beautiful red and gold color is obtained.

As described above, in order to set the retainer layer into very pale gold, pale gold, pale red and gold, and red and gold, the ratio of the total area of yellow dot printing to the total area of red dot printing is set to about 4~6:1, and the proportion of the total area of yellow dot printing to the total area of red dot printing is set to about 10~61% per unit area. As the color changes from very pale gold to red and gold, the gold color becomes a gold color having red tone. This is caused by increasing the total area of yellow and red printing.

Figure 42:
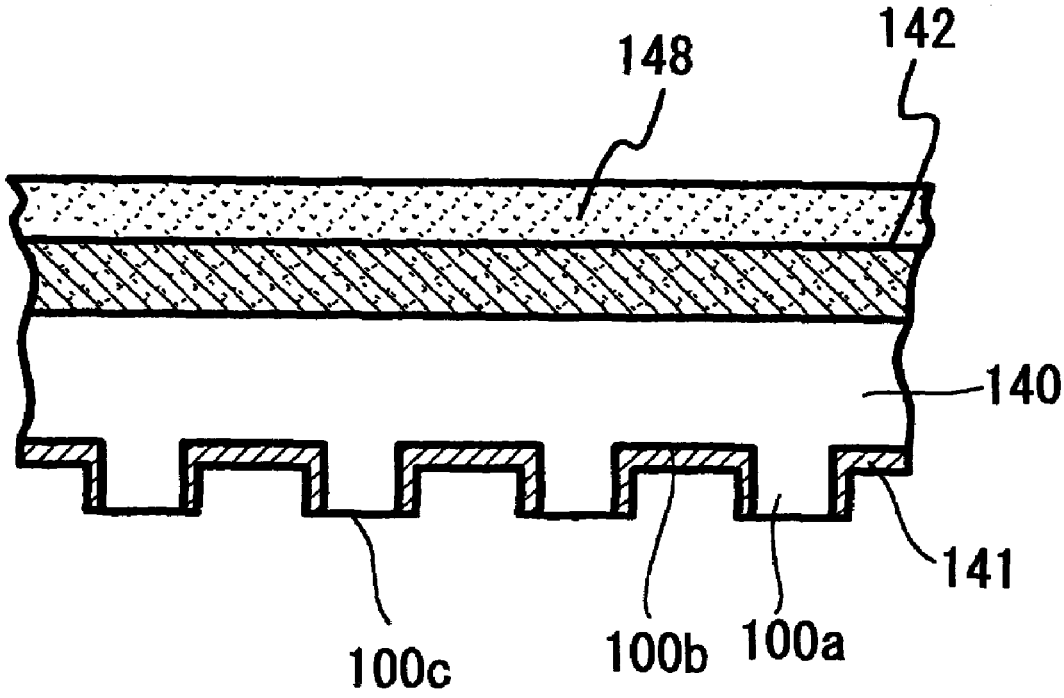
FIG. 42 is an enlarged sectional view of a gold colored watch dial provided with a retainer layer and a protector film according to the fourteenth embodiment.

In the dial shown in FIG. 42, transparent protector film 148 including ultraviolet rays absorbent is printed on the retainer layer 142, thereby obtaining a light-resistivity. In this case, the light-resistivity is increased by polishing the upper surface of the protector film 148 into a flat smooth face.

Figure 43:
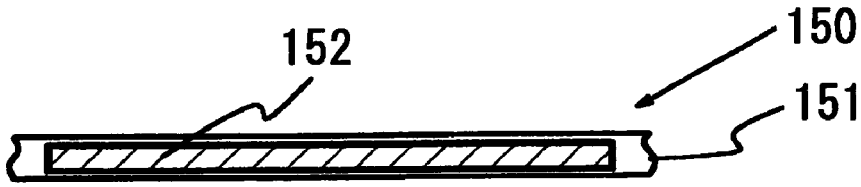
FIG. 43 shows a transcription film sheet used for forming a picture on the dial of the present invention.

FIG. 43 shows another transcription method for transcribing the sublimating dye. As shown in FIG. 43, transcription film sheet 150 comprises transparent film sheet 151 and a color portion 152 in the film sheet 151. The color portion 152 is formed by soaking the sublimating dye in the film sheet 151 under the heating and compression condition.

Figure 44:
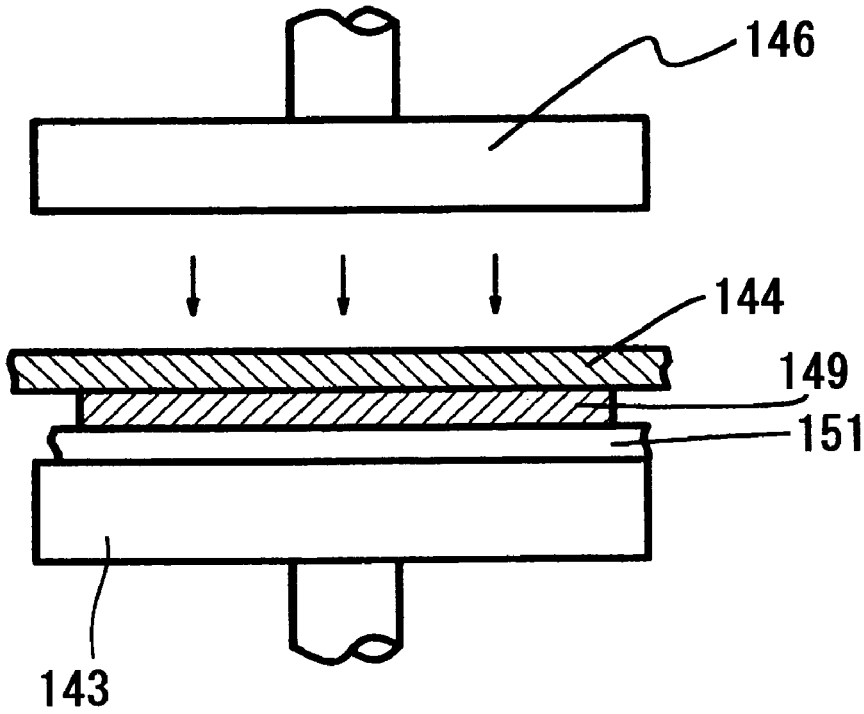
FIG. 44 shows a method for forming the transcription film sheet of FIG. 43.

FIG. 44 shows a method for forming the transcription film sheet 150. The transparent film sheet 151 is mounted on the base 143, and a transcription paper 144 having dots 149 of sublimating dye ink is mounted on the film sheet 151.

A pressing machine 146 presses the transcription paper 144, thereby forming the film sheet 150.

Figure 45:
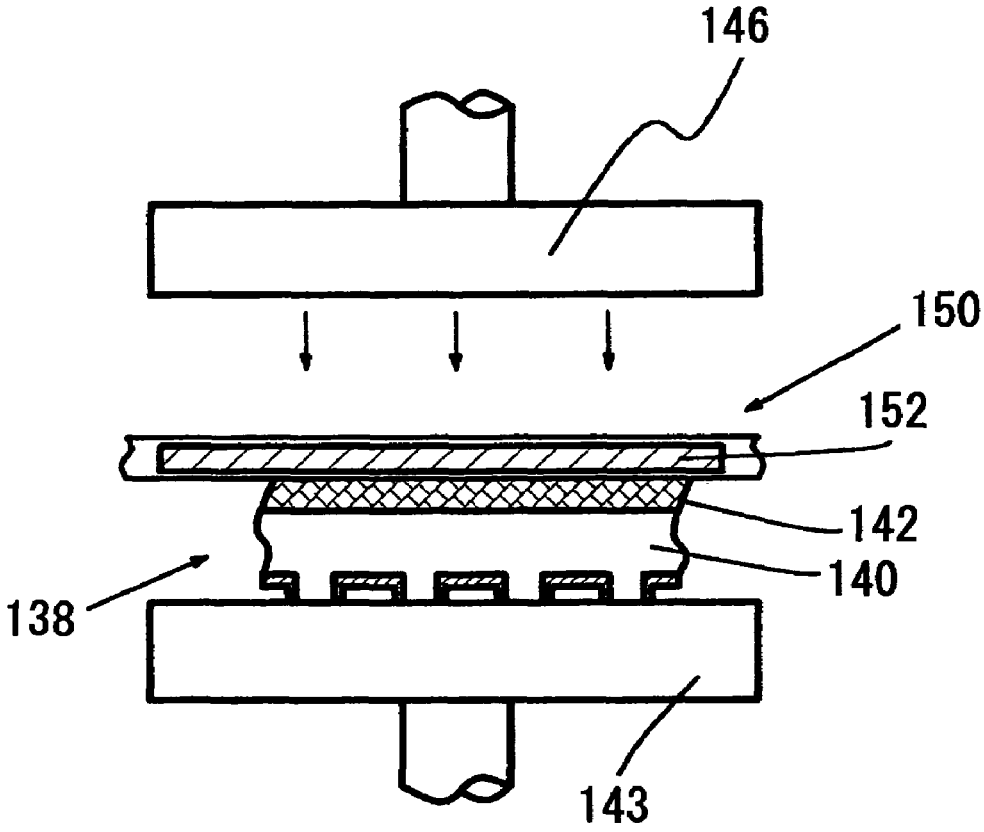
FIG. 45 shows a method for forming a picture on the watch dial of the present invention with a transcription paper.
Figure 46:
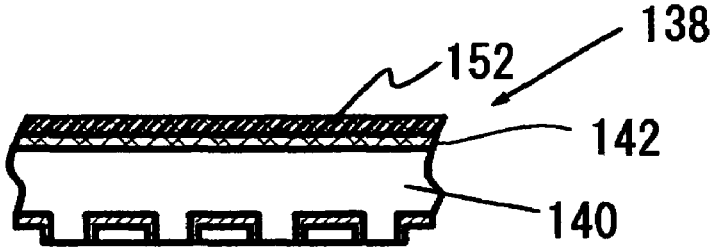
FIG. 46 is a sectional view after transcription.

FIGS. 45 and 46 show a method for transcribing the sublimating dye ink to the retainer layer. As shown in FIG. 45, the dial 138 comprising the substrate 140 and the retainer layer 142 is mounted on the base 143. The transcription film sheet 150 is superimposed on the dial 138. The film sheet 150 is pressed against the dial 138 by the pressing device 146 under the heating condition.

By the method, vaporized sublimating dye in the color portion 152 is soaked in the retainer layer 142.

Figure 47:
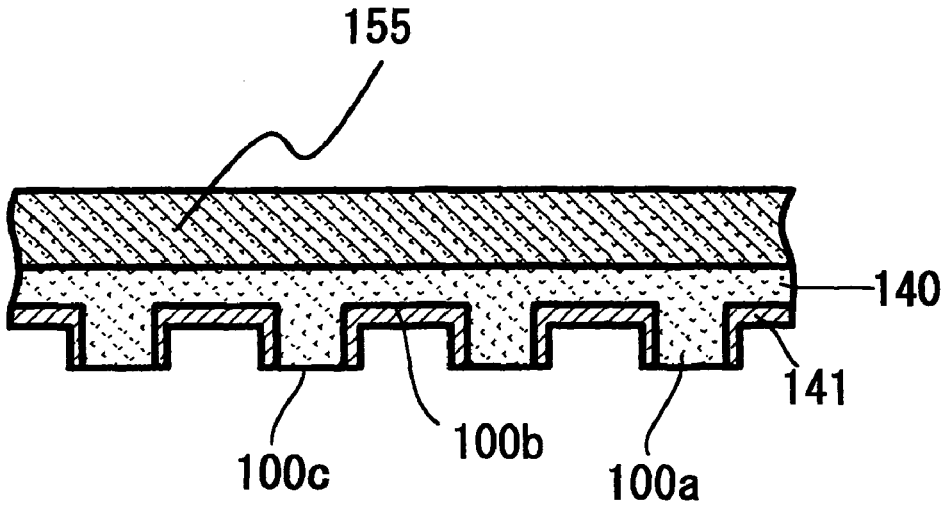
FIGS. 47 and 48 are sectional views showing modifications of the fourteenth embodiment.

FIG. 47 is a sectional view of a dial having a gold picture 155 transcribed on the substrate 140 including ultraviolet rays absorbent.

Figure 48:
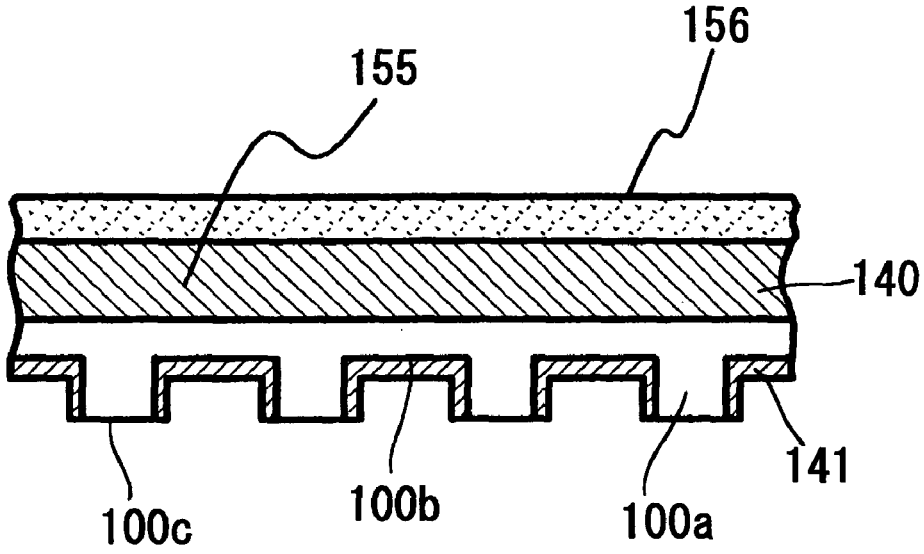
Figure 49:
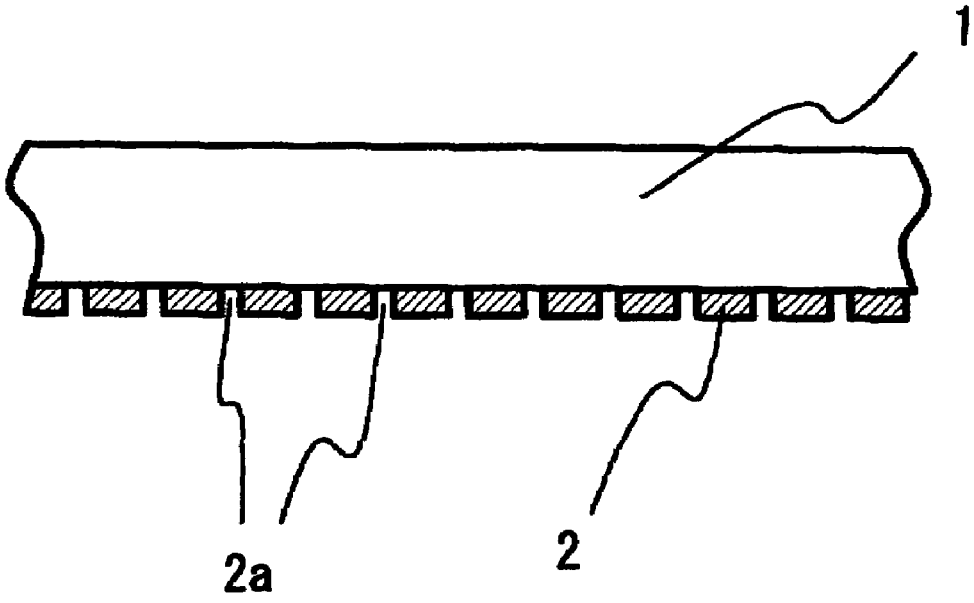
FIG. 49 is an enlarged sectional view of a conventional watch dial.
Figure 50:
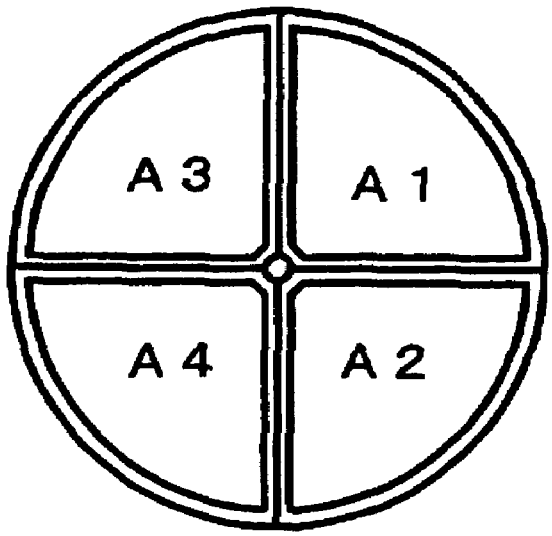
FIG. 50 is an elevational view of a solar cell for a watch.

FIG. 48 shows a dial having a transparent protector film 156 including ultraviolet rays absorbent mounted on the picture 155.

PROBABILTY OF INDUSTRIAL EXPLOITATION

In accordance with the present invention, it is possible to provide a watch dial in which deep purple of the solar cell is invisible and clear picture is superior in light-resistivity and kept for a long term.

The invention claimed is:

1. A solar cell watch comprising an outer dial and an inner solar cell, the outer dial comprising:

a transmissive substrate;

a series of projections and recesses formed on a first surface of the substrate oriented toward the inner solar cell, the series of projections and recesses being in regularly distributed disposition over a whole area of the first surface, each of the projections being disposed between recesses;

a nontransmissive film formed on a whole inner surface of each of the recesses;

a transmissive portion formed on a top of each of the projections; and a light passage being formed in each of the projections, such that light outside the dial assembly passes through the light passage, wherein the width of the light passages is 70 μm or less, and the total area of the light passages is between 20 and 50% of the area of a second surface opposite the first surface.

2. The watch according to claim 1 wherein the nontransmissive film has reflectance.

3. The watch according to claim 1 wherein the series of projections and recesses are formed into a pattern selected from the group consisting of a latticed pattern, a stripe pattern, a circle pattern and a geometric pattern.

4. The watch according to claim 1 wherein the substrate is colored.

5. The watch according to claim 1 wherein a projected surface of the projection is formed into a flat smooth face.

6. The watch according to claim 1 wherein the projection is formed into a wave shape having a trapezoid section.

7. The watch according to claim 1 further comprising a colored transmissive film formed on an underside of the nontransmissive film in the recess.

8. The watch according to claim 1 further comprising a plurality of projections formed on a second surface opposite to the first surface.

9. The watch according to claim 8 further comprising a transparent protection film formed on the projections and recesses on the second surface of the substrate.

10. The watch according to claim 9 wherein an ultraviolet rays absorbent is included in the transparent protection film.

11. The watch according to claim 1 wherein the recess is formed into a semispherical shape with respect to incident light.

12. The watch according to claim 11 further comprising a plurality of lenses formed on a second surface opposite to the first surface of the substrate, corresponding to the semispherical recess.

13. The watch according to claim 1 wherein the nontransmissive film is a metallic film.

14. The watch according to claim 1 wherein the nontransmissive film is a painting film.

15. The watch according to claim 1 wherein the projections and the recesses are disposed at regular intervals.

16. The watch according to claim 1 wherein an upper surface of the transmissive substrate is a flat smooth surface.

17. A method for manufacturing a solar cell watch, comprising the steps of:

forming a transmissive substrate having a series of projections and recesses on a whole area of a first surface of the substrate by injecting a transparent resin in a mold having projections and recesses;

forming a nontransmissive film on the first surface including the projections and recesses;

removing the nontransmissive film on a projected surface of each of the projections to expose the transmissive surface of the substrate;

forming the exposed surface of the projected surface of the substrate into a flat smooth surface, and orienting the first surface toward a solar cell, and an opposite surface for exposure to ambient light.

18. The method according to claim 17 further comprising the steps of:

forming each of the projections into a triangular section;

removing a peak portion of the triangular section; and forming the removed portion into a flat smooth surface.

19. The method according to claim 17 further comprising:

forming the nontransmissive film on the projections and recesses into a projection and recess shape along the projections and recesses.

20. The method according to claim 17 further comprising:

forming the surface of the nontransmissive film in the recess and the surface of the exposed surface of the substrate into a coplanar surface.

* * * * *